US010081189B2

(12) United States Patent
Shimazu et al.

(10) Patent No.: US 10,081,189 B2
(45) Date of Patent: Sep. 25, 2018

(54) RECORDING APPARATUS

(71) Applicant: SEIKO EPSON CORPORATION, Tokyo (JP)

(72) Inventors: Masamitsu Shimazu, Shiojiri (JP); Makoto Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/643,246

(22) Filed: Jul. 6, 2017

(65) Prior Publication Data

US 2018/0009226 A1 Jan. 11, 2018

(30) Foreign Application Priority Data

Jul. 11, 2016 (JP) ..... 2016-136522

(51) Int. Cl.

| | |
|---|---|
| ***B41J 2/16*** | (2006.01) |
| ***B41J 2/165*** | (2006.01) |
| ***B41J 25/308*** | (2006.01) |
| *B41J 11/42* | (2006.01) |
| *B41J 11/00* | (2006.01) |

(52) U.S. Cl.

CPC ..... *B41J 2/16505* (2013.01); *B41J 25/308* (2013.01); *B41J 11/007* (2013.01); *B41J 11/42* (2013.01)

(58) Field of Classification Search

CPC ..... B41J 2/16505; B41J 25/308; B41J 11/42; B41J 11/007; B25J 9/042

See application file for complete search history.

(56) References Cited

U.S. PATENT DOCUMENTS

2010/0073700 A1* 3/2010 Uematsu ..... B41J 3/4071 358/1.13

FOREIGN PATENT DOCUMENTS

| | | |
|---|---|---|
| JP | 2006-193302 A | 7/2006 |
| JP | 2014-034118 A | 2/2014 |

* cited by examiner

*Primary Examiner* — Henok Legesse
(74) *Attorney, Agent, or Firm* — Workman Nydegger

(57) ABSTRACT

A recording apparatus includes a carriage, a medium support member, a gap switching unit, and a maintenance unit. The carriage includes a recording head configured to record on a medium. The medium support member is provided at a position facing the recording head and is configured to support the medium. The gap switching unit is configured to switch a gap between the medium support member and the recording head. The maintenance unit is configured to perform maintenance on the recording head. The gap switching unit and the maintenance unit are driven by a common motor.

4 Claims, 20 Drawing Sheets

RECORDING APPARATUS

BACKGROUND

1. Technical Field

The entire disclosure of Japanese Patent Application No: 2016-136522, filed Jul. 11, 2016 is expressly incorporated by reference herein in its entirety.

The present invention relates to a recording apparatus that records on a medium.

2. Related Art

Ink jet printers, these being an example of recording apparatuses, include what are referred to as serial ink jet printers configured to record by ejecting a liquid (for example ink) onto a medium from a recording head, while a carriage mounted with the recording head moves to and fro in a main scanning direction. Such serial ink jet printers are provided with a motor to drive the carriage.

Ink jet printers also include various drive targets that are driven by motors. Examples of these include feeder rollers that feed out recording paper, this being an example of a medium, from a paper storage section in which the paper is stored, and transport rollers that transport the recording paper. Another example of a drive target is an ink suction pump that sucks ink from the recording head through a cap that caps the recording head.

Moreover, since recording paper comes in various thicknesses, gap switching units are also provided. The gap switching unit switches a gap between the recording head and a recording paper support member disposed facing the recording head according to the type of recording paper. This gap switching unit is another example of a drive target that is driven by a motor.

Since recording apparatuses are provided with various such drive targets, providing dedicated motors for each of the drive targets would increase the apparatus size and lead to a marked increase in costs. Accordingly, configurations have been adopted hitherto in which plural drive targets are driven by a single motor (see, for example, JP-A-2014-034118).

In the printer described in JP-A-2014-034118, a gap switching unit and feed rollers are driven by a single motor. Accordingly, a gap switching operation and a paper feed operation cannot be performed at the same time, this being a factor that hinders an improvement in throughput.

SUMMARY

An advantage of some aspects of the invention is a configuration in which plural drive targets are driven by a single motor, having more appropriate drive targets, and thereby enabling more efficient operation to be achieved.

A recording apparatus according to a first aspect of the invention includes a carriage, a medium support member, a gap switching unit, and a maintenance unit. The carriage includes a recording head configured to record on a medium. The medium support member is provided at a position facing the recording head and is configured to support the medium. The gap switching unit is configured to switch a gap between the medium support member and the recording head. The maintenance unit is configured to perform maintenance on the recording head. In the recording apparatus, the gap switching unit and the maintenance unit are driven by a common motor.

According to this aspect, the maintenance unit and the gap switching unit are driven by a common motor. Using the common motor to drive both the maintenance unit and the gap switching unit, which there is little need to operate at the same time, improves the degrees of freedom for other drive targets, enabling more efficient operation of the recording apparatus to be achieved.

In the above aspect, it is preferable that the maintenance unit include a cap section that is configured to switch between a capped state capping the recording head and a non-capped state separated from the recording head, and a pump that generates negative pressure in the cap section. The cap section and the pump are driven by the motor.

According to this configuration, in which the maintenance unit includes the cap section and the pump, and both the cap section and the pump are driven by the motor, similar operation and advantageous effects can be obtained to those of the first aspect described above.

In the above aspect, it is preferable that the motor, a first motive force transmission unit configured to transmit motive force from the motor to the gap switching unit, the maintenance unit, and a second motive force transmission unit configured to transmit motive force from the motor to the cap section be provided at one side end section of an apparatus body in an apparatus width direction. At least a portion of the first motive force transmission unit and at least a portion of the second motive force transmission unit overlap with each other in the apparatus width direction.

According to this configuration, at least a portion of the first motive force transmission unit and at least a portion of the second motive force transmission unit overlap with each other in the apparatus width direction. This thereby enables an apparatus width direction dimension of the recording apparatus including the first motive force transmission unit and the second motive force transmission unit to be suppressed.

In the above aspect, it is preferable that at least a portion of the maintenance unit and at least a portion of the second motive force transmission unit overlap with each other in the apparatus width direction.

According to this configuration, at least a portion of the maintenance unit and at least a portion of the second motive force transmission unit overlap with each other in the apparatus width direction. This thereby enables the apparatus width direction dimension of the recording apparatus including the maintenance unit and the second motive force transmission unit to be suppressed.

In the above aspect, it is preferable that the first motive force transmission unit include a planetary gear mechanism that is configured to transmit motive force to the gap switching unit using rotation of the motor in a first direction, and that is configured to cut off motive force transmission to the gap switching unit when the motor rotates in a second direction opposite to the first direction. It is also preferable that the second motive force transmission unit be configured to transmit rotational motive force to the maintenance unit in a direction in which the maintenance unit performs maintenance on the recording head when the motor rotates in the second direction, and to transmit rotational motive force to the maintenance unit in a direction in which the maintenance unit does not perform maintenance on the recording head when the motor rotates in the first direction.

According to this configuration, a difference in the rotation direction of the motor can be utilized to drive the gap switching unit and the maintenance unit using a single motor.

Another aspect of the invention is a recording apparatus including a carriage that includes a recording head configured to record on a medium, a maintenance unit that is configured to perform maintenance on the recording head, a feed unit configured to feed the medium, a first motor configured to drive the maintenance unit, and a second motor configured to drive the feed unit. In the recording apparatus, at least a portion of the first motor and at least a portion of the second motor overlap with each other in an apparatus width direction.

According to this aspect, at least a portion of the first motor and at least a portion of the second motor overlap with each other in the apparatus width direction. This thereby enables the apparatus width direction dimension of the recording apparatus including the first motor and the second motor to be suppressed.

Another aspect of the invention is a recording apparatus including a carriage that includes a recording head configured to record on a medium, a maintenance unit that is configured to perform maintenance on the recording head, a feed unit configured to feed the medium, a first motor configured to drive the maintenance unit, and a second motor configured to drive the feed unit. In the recording apparatus, at least a portion of the first motor and at least a portion of the second motor overlap with each other in an apparatus depth direction.

According to this aspect, at least a portion of the first motor and at least a portion of the second motor overlap with each other in the apparatus depth direction. This thereby enables an apparatus depth direction dimension of the recording apparatus including the first motor and the second motor to be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
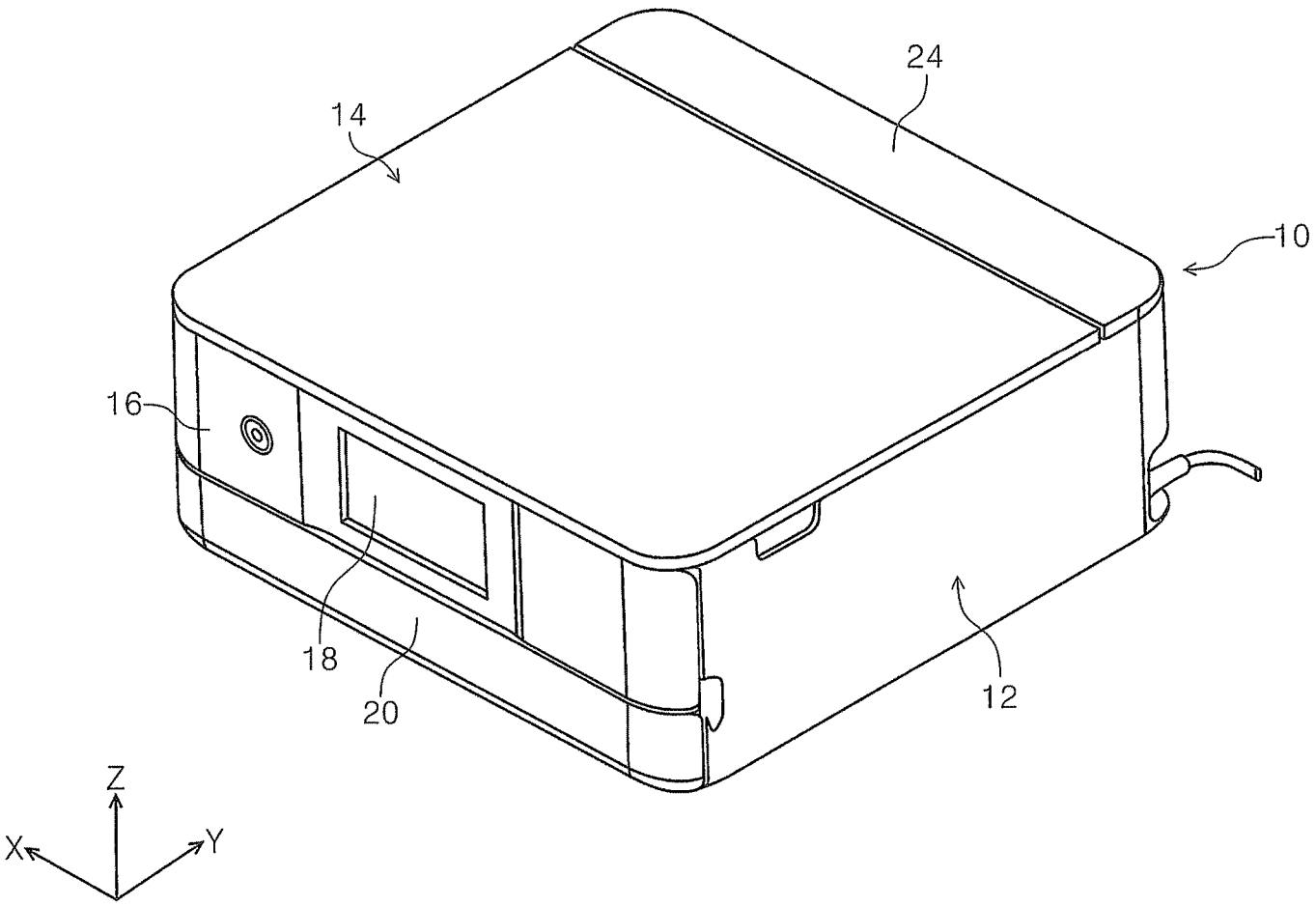
FIG. 1 is an external perspective view illustrating a printer according to the invention.

Explanation follows regarding embodiments of the invention, with reference to the drawings. Note that equivalent configurations in the respective embodiments are allocated the same reference numerals, and are only described in the initial embodiment, with explanation of such configurations being omitted in subsequent embodiments.

Figure 2:
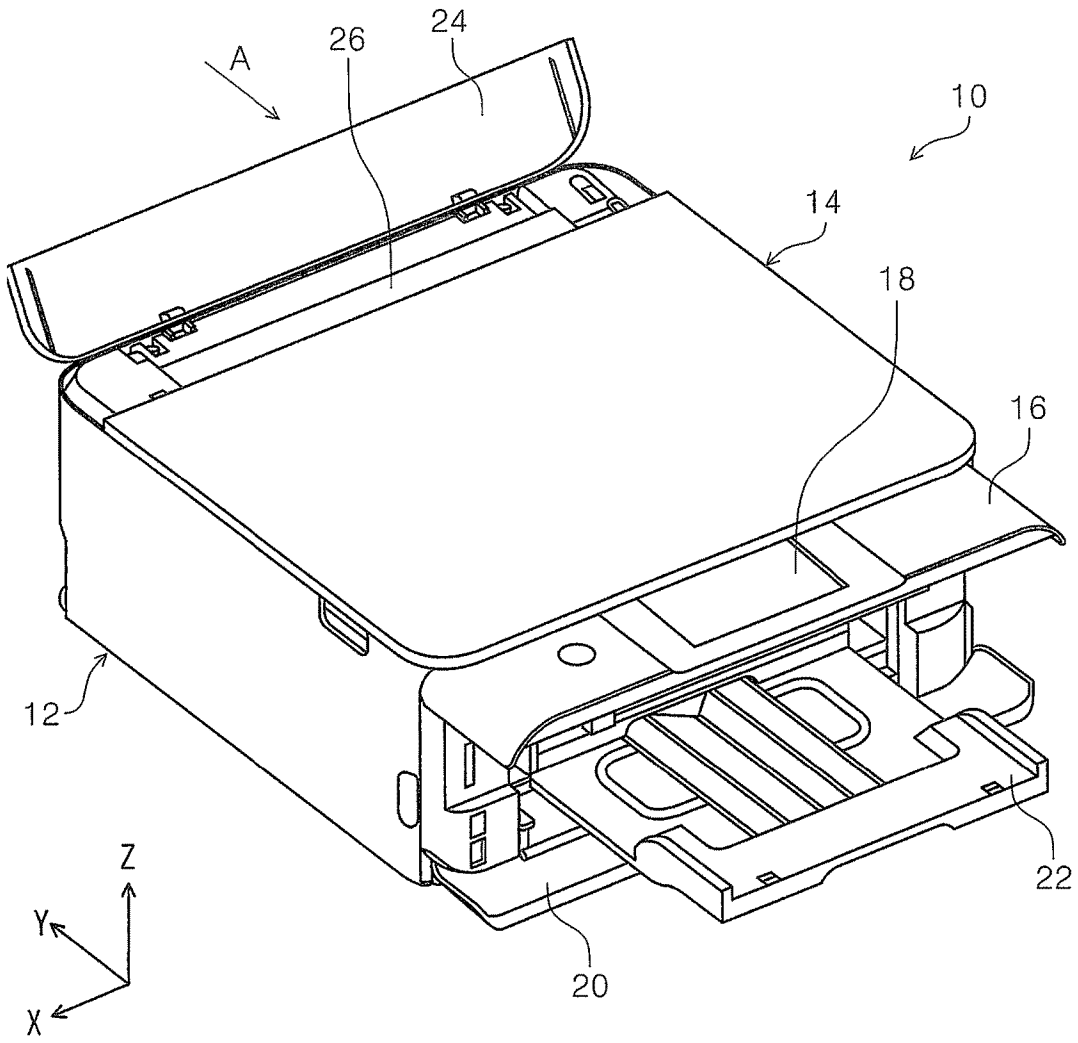
FIG. 2 is a perspective view illustrating a printer according to the invention in a state in which a discharge tray has been opened out.
Figure 3:
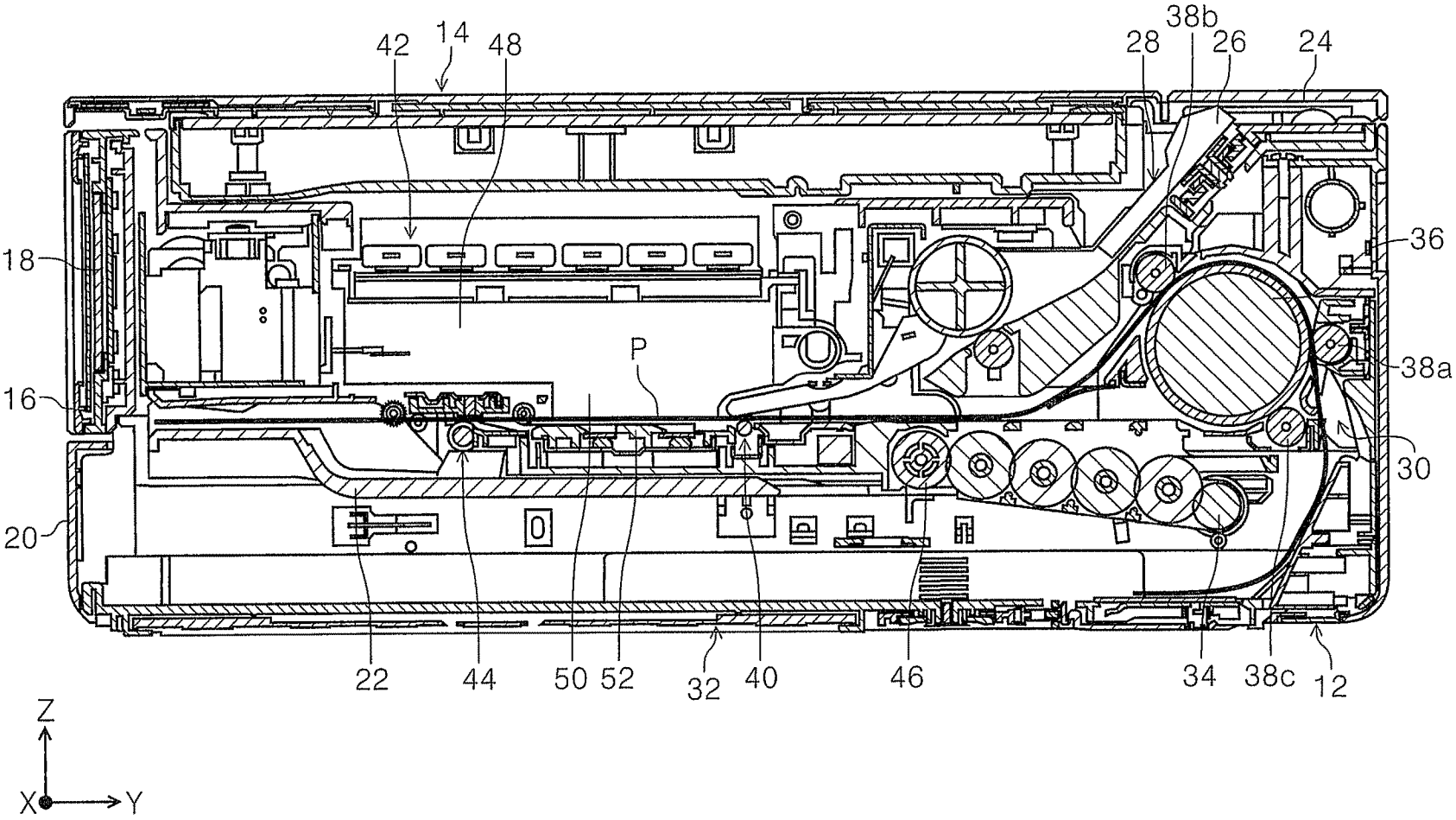
FIG. 3 is a side view cross-section illustrating a medium transport path of a printer according to the invention.
Figure 4:
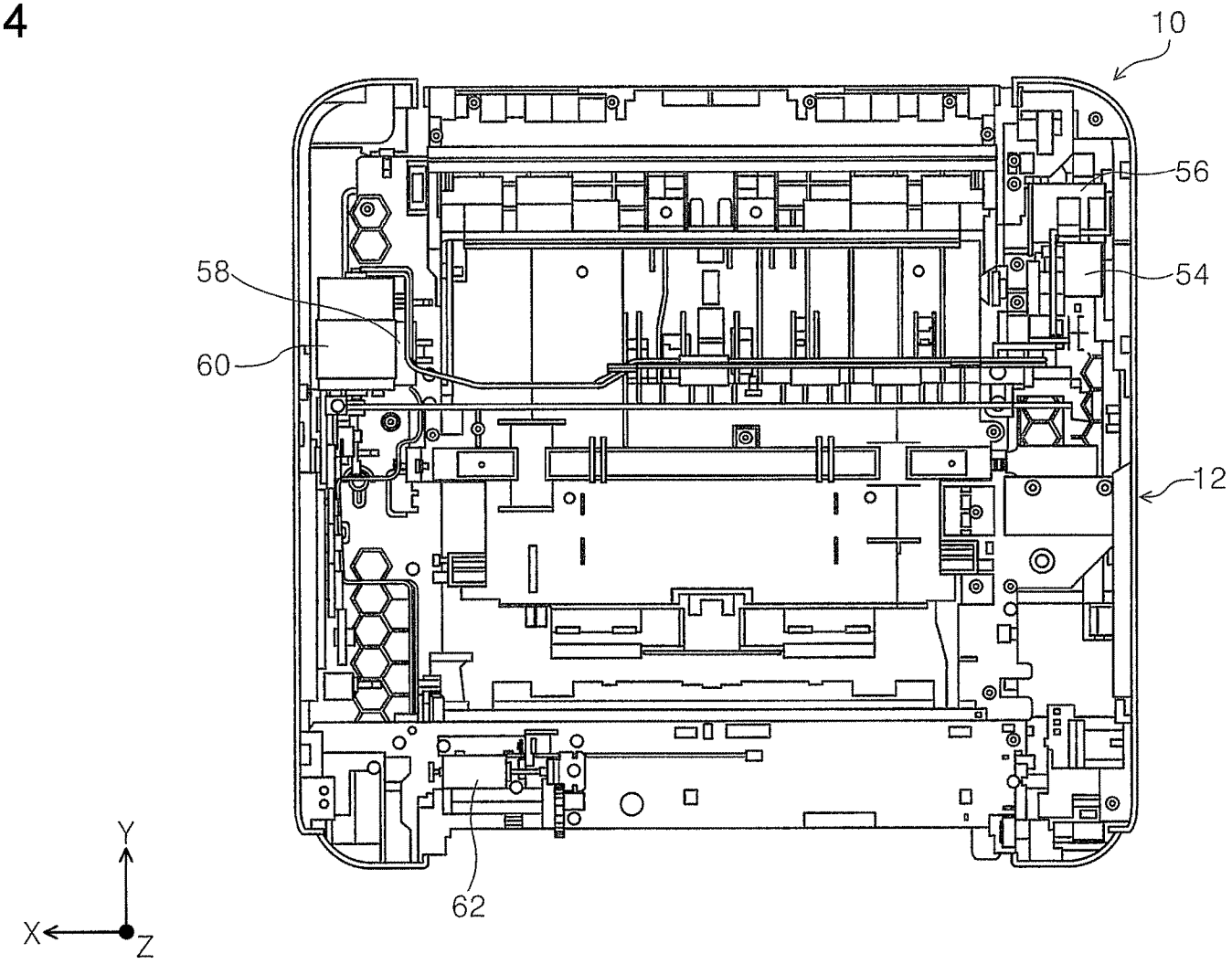
FIG. 4 is a plan view illustrating an apparatus body, to explain a placement state of plural motors in an apparatus body of a printer according to the invention.
Figure 5:
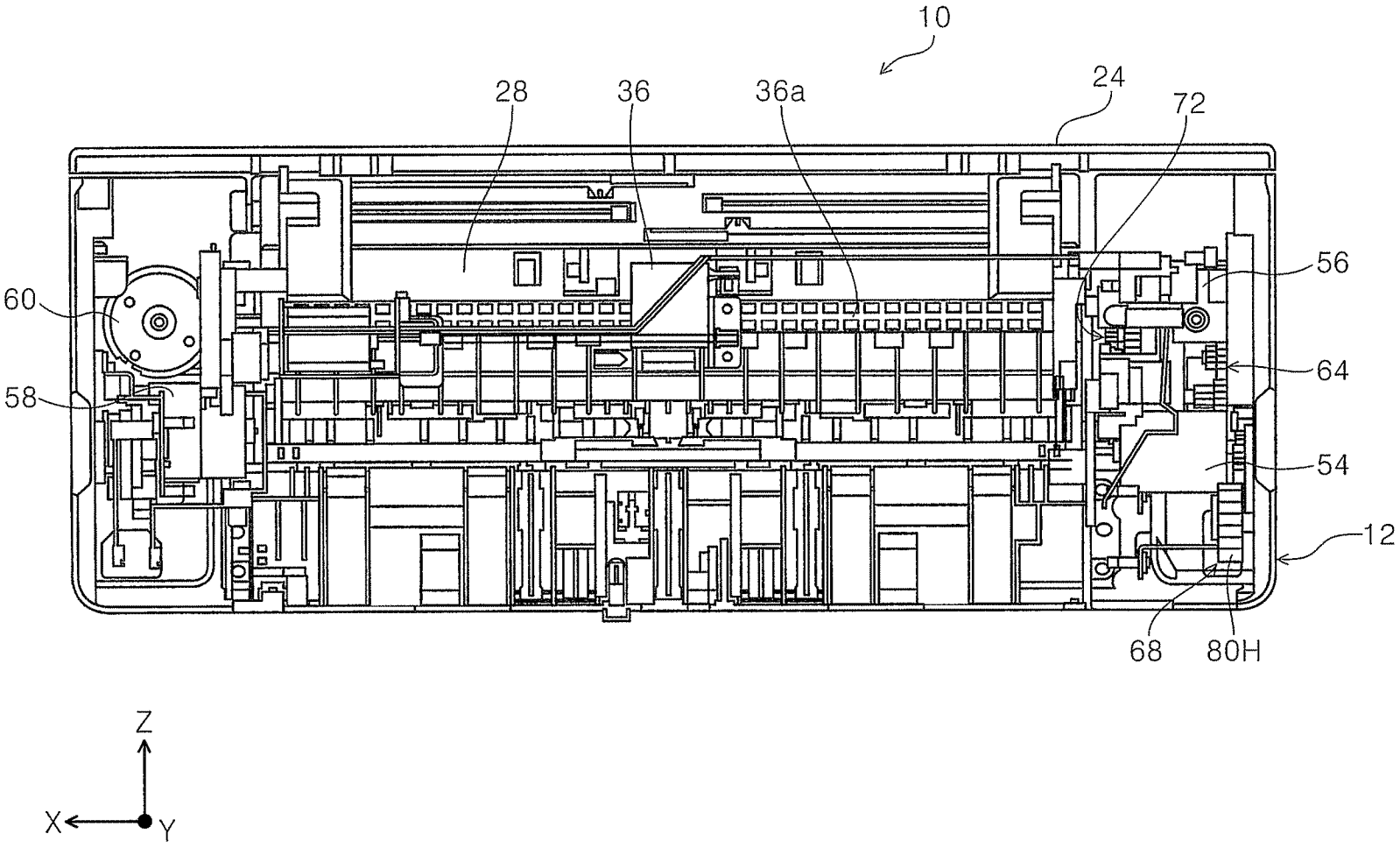
FIG. 5 is a face-on view illustrating an apparatus body, to explain a placement state of plural motors in an apparatus body of a printer according to the invention.
Figure 6:
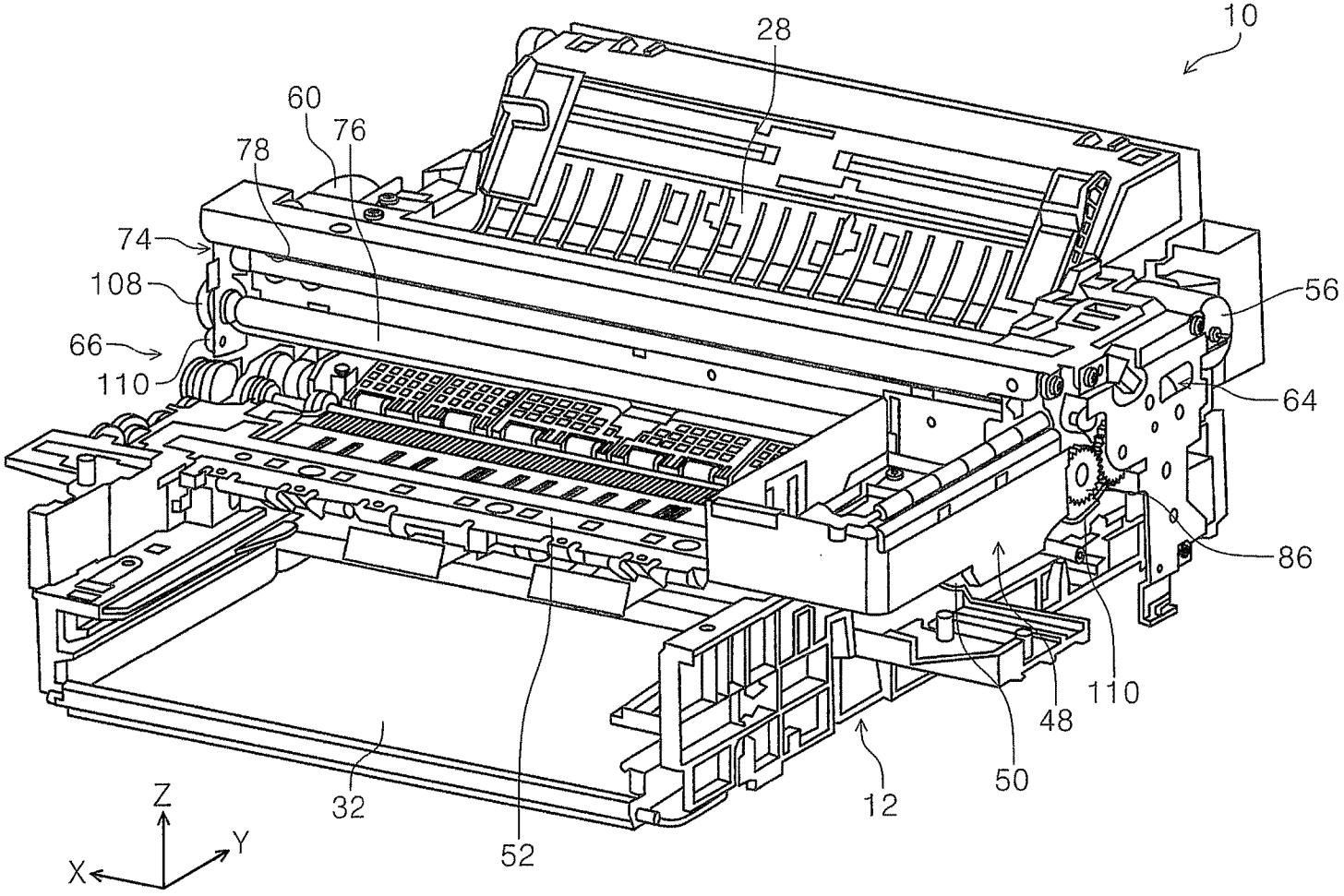
FIG. 6 is a perspective view illustrating an apparatus body of a printer according to the invention.
Figure 7:
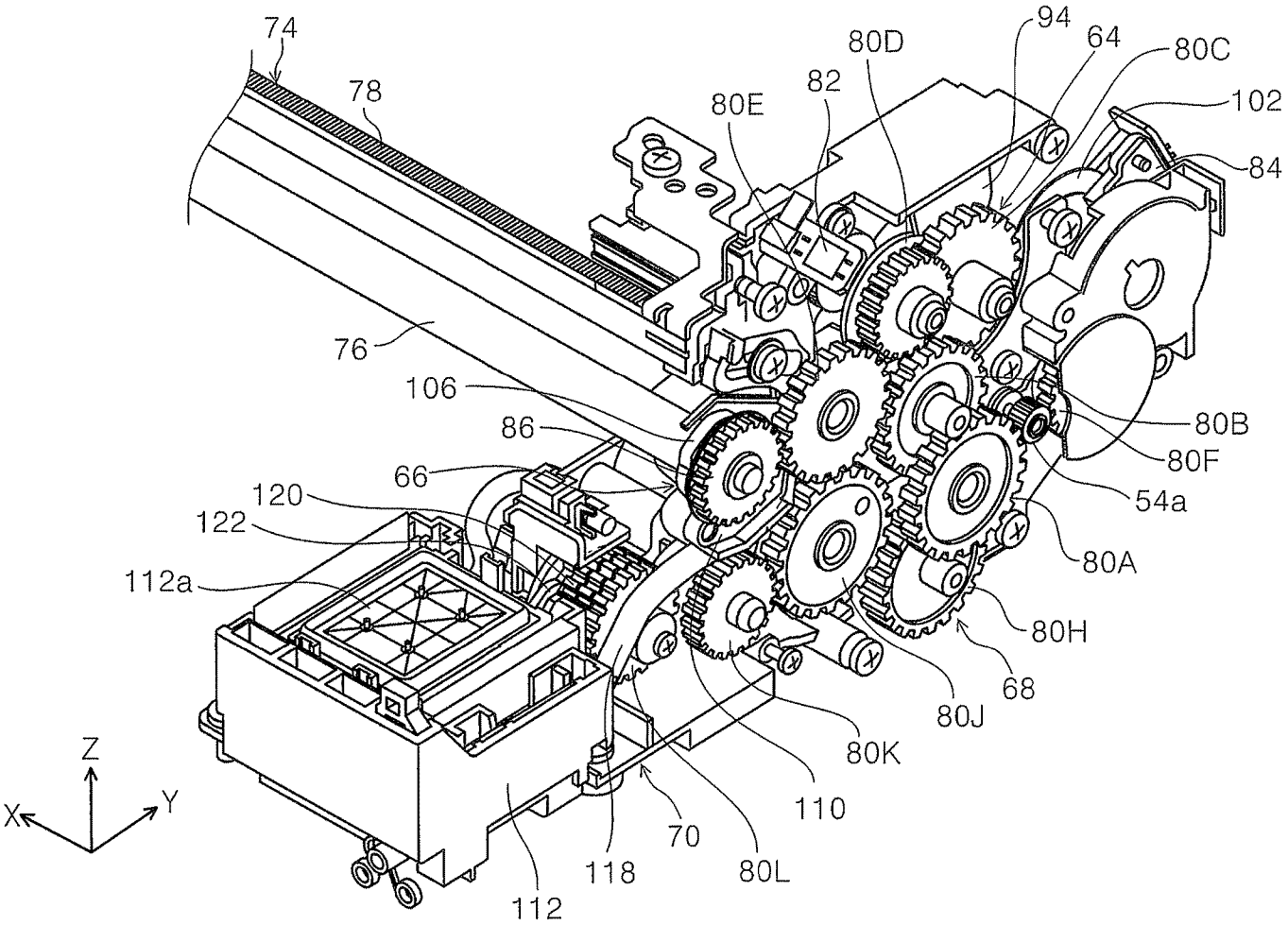
FIG. 7 is a perspective view illustrating a first motive force transmission unit, a second motive force transmission unit, and a maintenance unit of the invention.

FIG. 1 is an external perspective view illustrating a printer according to the invention. FIG. 2 is a perspective view illustrating a printer according to the invention in a state in which a discharge tray has been opened out. FIG. 3 is a side view cross-section illustrating a medium transport path of a printer according to the invention. FIG. 4 is a plan view illustrating an apparatus body, to explain a placement state of plural motors in an apparatus body of a printer according to the invention. FIG. 5 is a face-on view illustrating an apparatus body, to explain a placement state of plural motors in an apparatus body of a printer according to the invention. FIG. 6 is a perspective view illustrating an apparatus body of a printer according to the invention. FIG. 7 is a perspective view illustrating a first motive force transmission unit and, a second motive force transmission unit, and a maintenance unit according to the invention.

Figure 8:
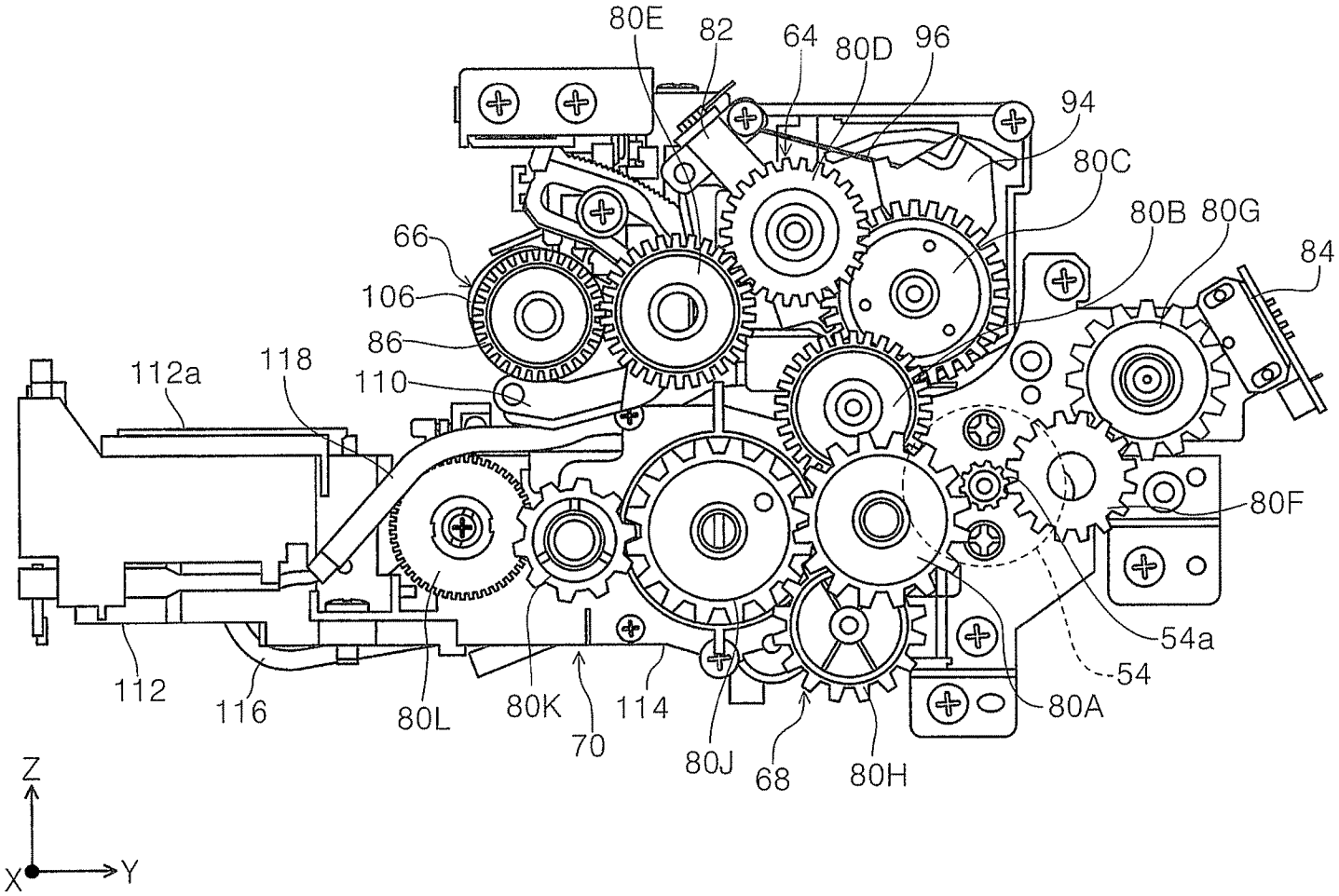
FIG. 8 is a face-on view illustrating a first motive force transmission unit, a second motive force transmission unit, and a maintenance unit according to the invention.
Figure 9:
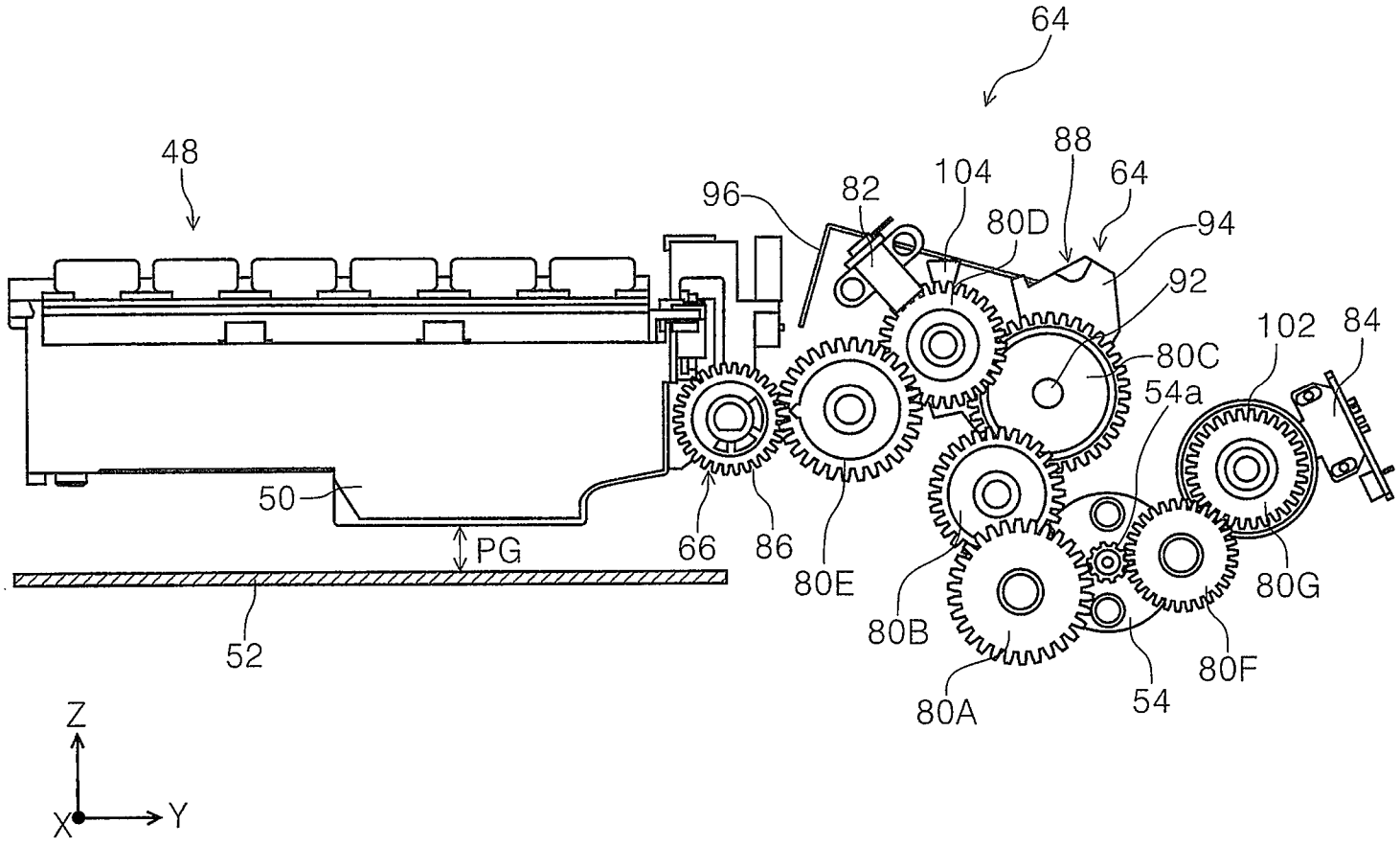
FIG. 9 is a face-on view illustrating a gap switching unit and a first motive force transmission unit.
Figure 10:
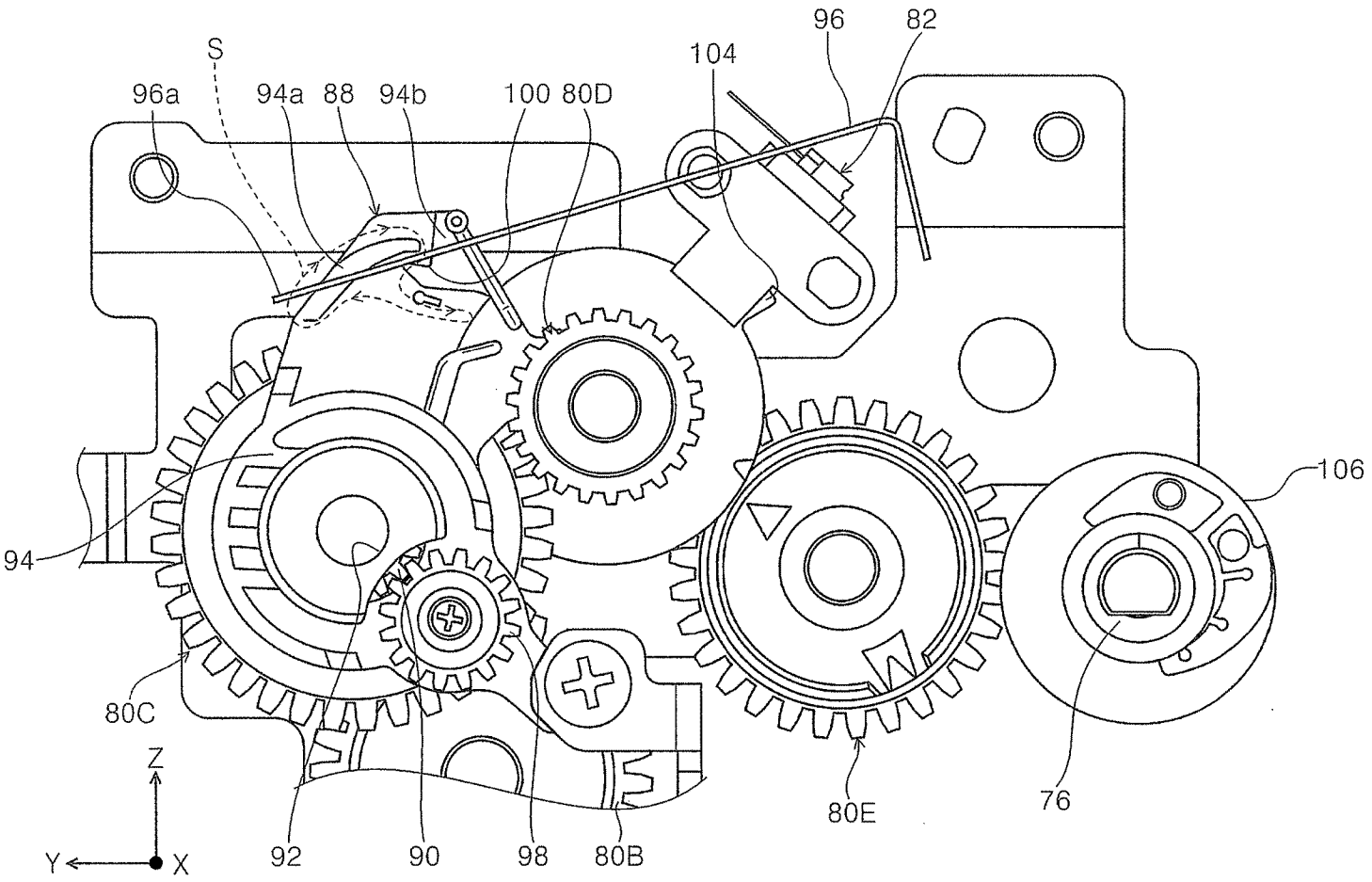
FIG. 10 is a face-on view illustrating a first motive force transmission unit when a planetary gear mechanism of the first motive force transmission unit is in a disengaged state.
Figure 11:
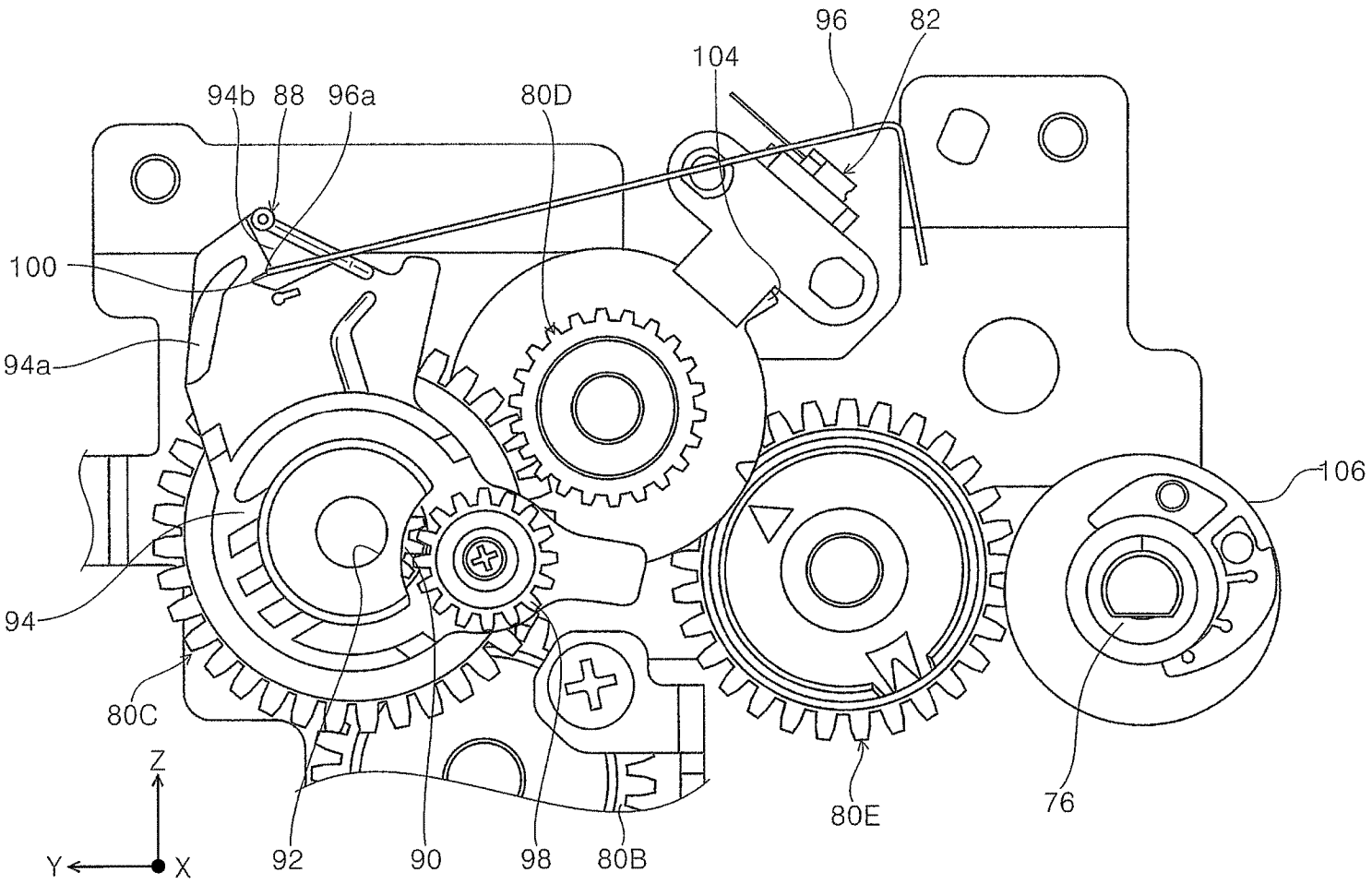
FIG. 11 is a face-on view illustrating a first motive force transmission unit in a state partway through switching from a disengaged state to a motive force transmission state of a planetary gear mechanism of the first motive force transmission unit.
Figure 12:
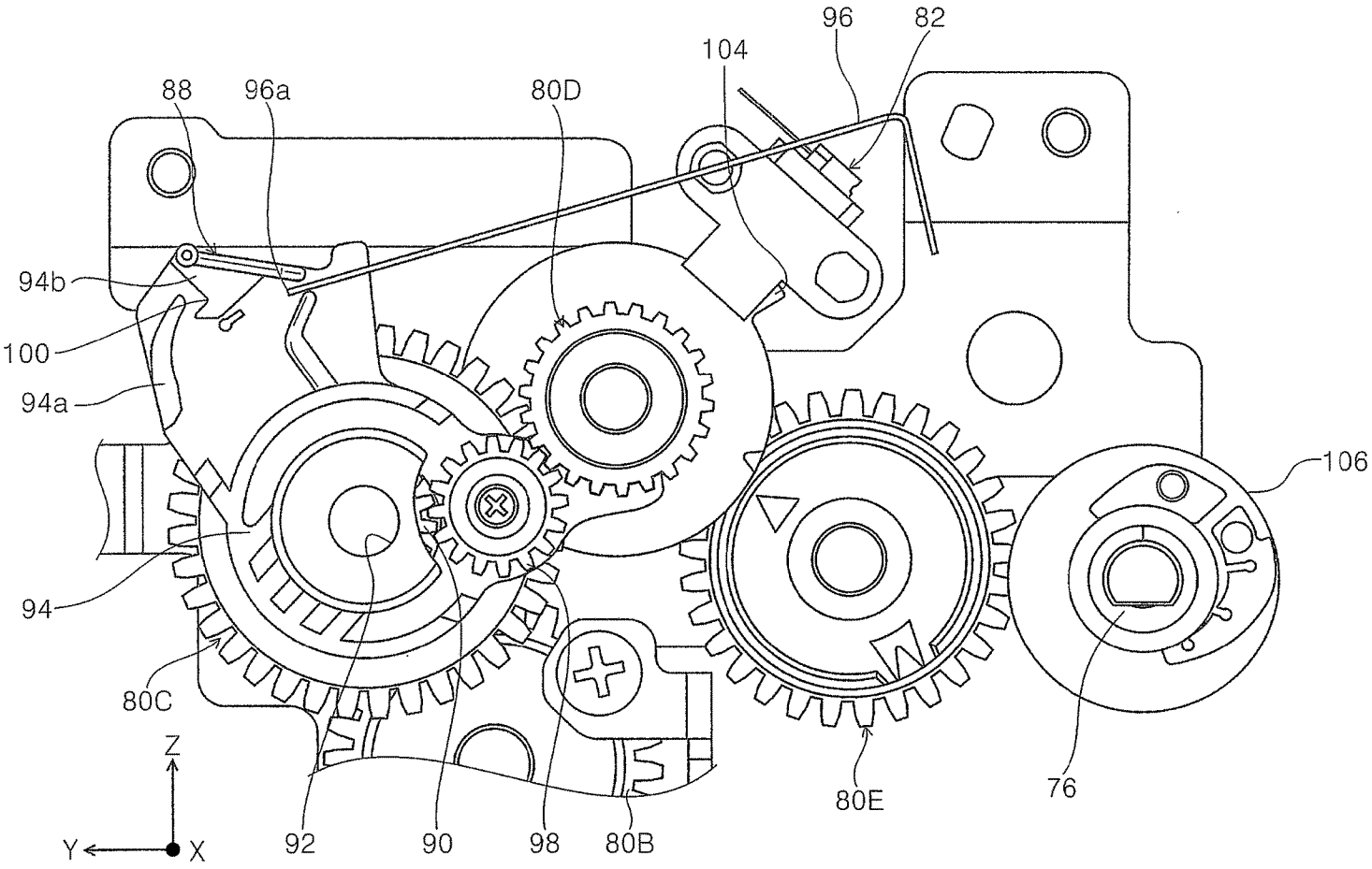
FIG. 12 is a face-on view illustrating a first motive force transmission unit in a state in which a planetary gear mechanism of the first motive force transmission unit is in a motive force transmission state.
Figure 13:
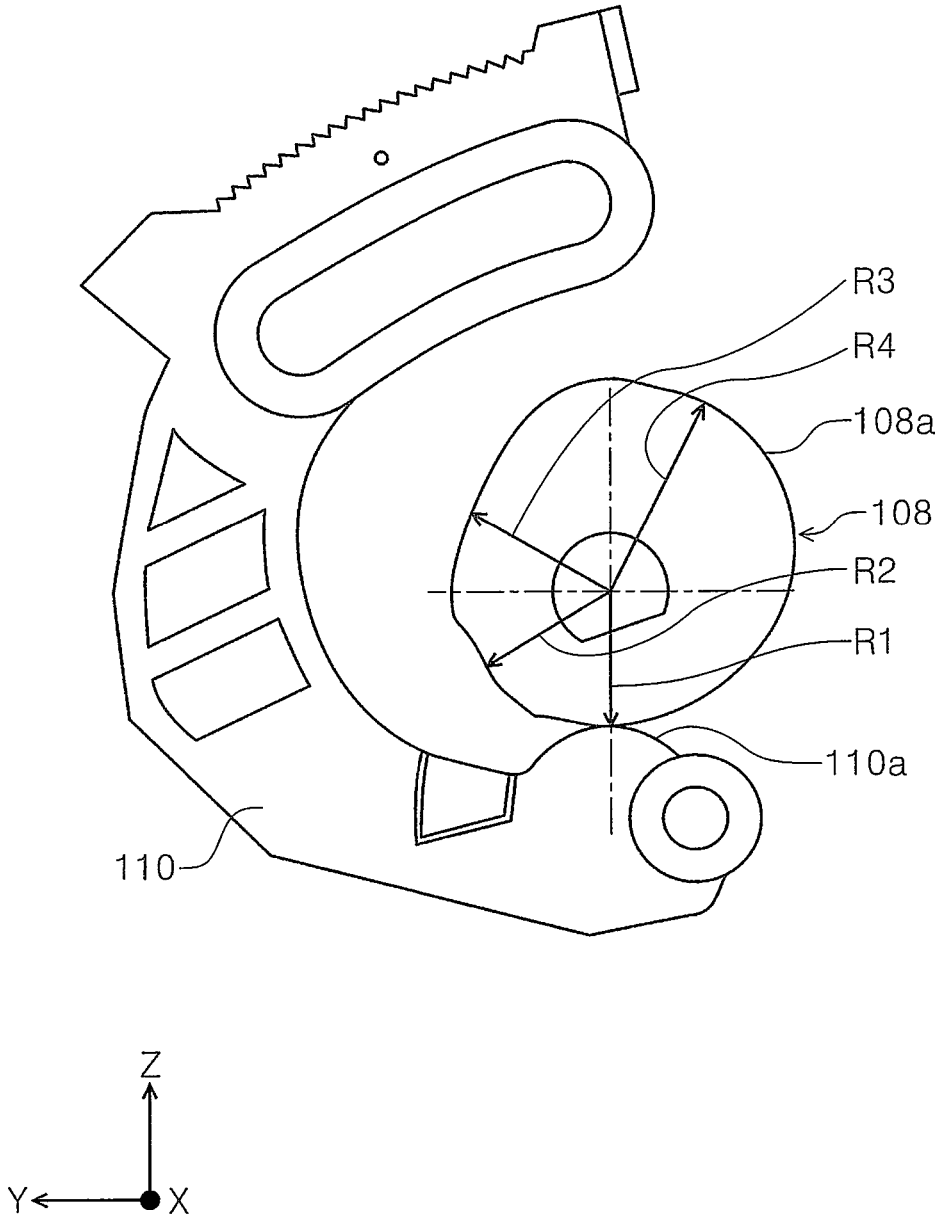
FIG. 13 is a face-on view illustrating a gap adjustment cam supported by a support member.

FIG. 8 is a face-on view illustrating a first motive force transmission unit, a second motive force transmission unit, and a maintenance unit according to the invention. FIG. 9 is a face-on view illustrating a gap switching unit and a first motive force transmission unit. FIG. 10 is a face-on view illustrating a first motive force transmission unit when a planetary gear mechanism of the first motive force transmission unit is in a disengaged state. FIG. 11 is a face-on view illustrating a first motive force transmission unit in a state partway through switching from a disengaged state to a motive force transmission state of a planetary gear mechanism of the first motive force transmission unit. FIG. 12 is a face-on view illustrating a first motive force transmission unit in a state in which a planetary gear mechanism of the first motive force transmission unit is in a motive force transmission state. FIG. 13 is a face-on view illustrating a gap adjustment cam supported by a support member. FIG.

14 is a perspective view illustrating a second motive force transmission unit and a maintenance unit.

Figure 15:
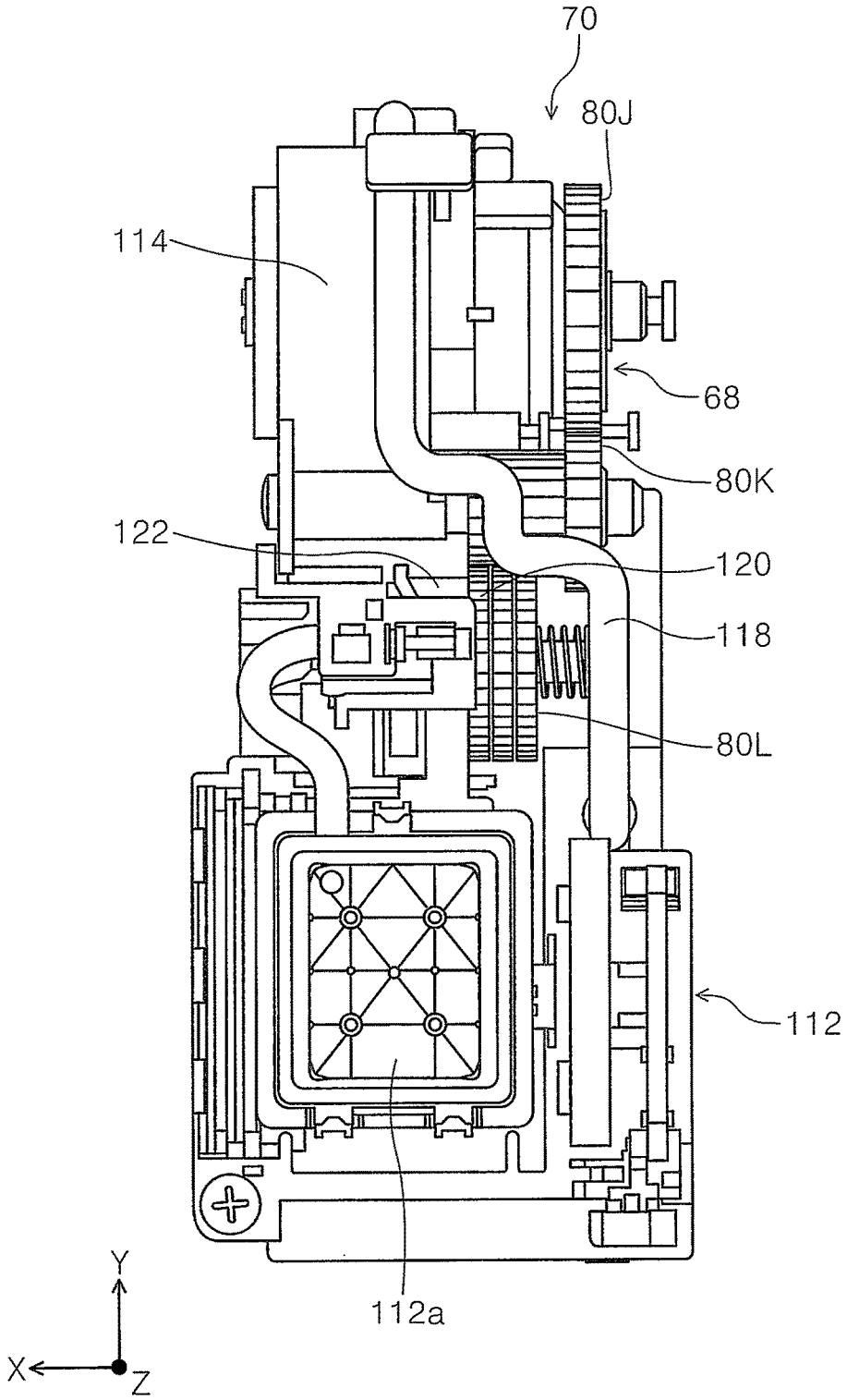
FIG. 15 is a plan view illustrating a maintenance unit.
Figure 16:
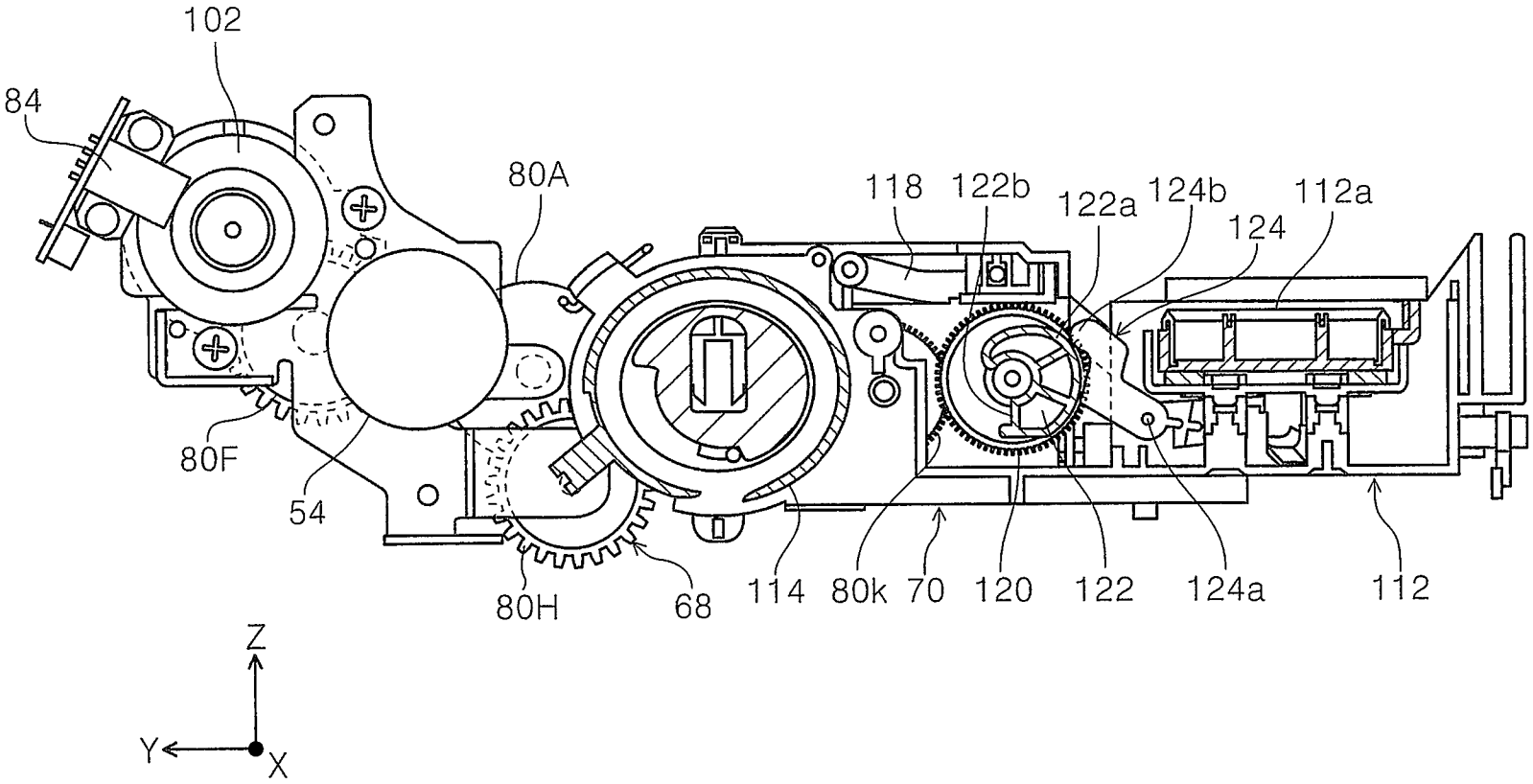
FIG. 16 is a side view cross-section illustrating a maintenance unit when a cap section of the maintenance unit is in a non-capped state.
Figure 17:
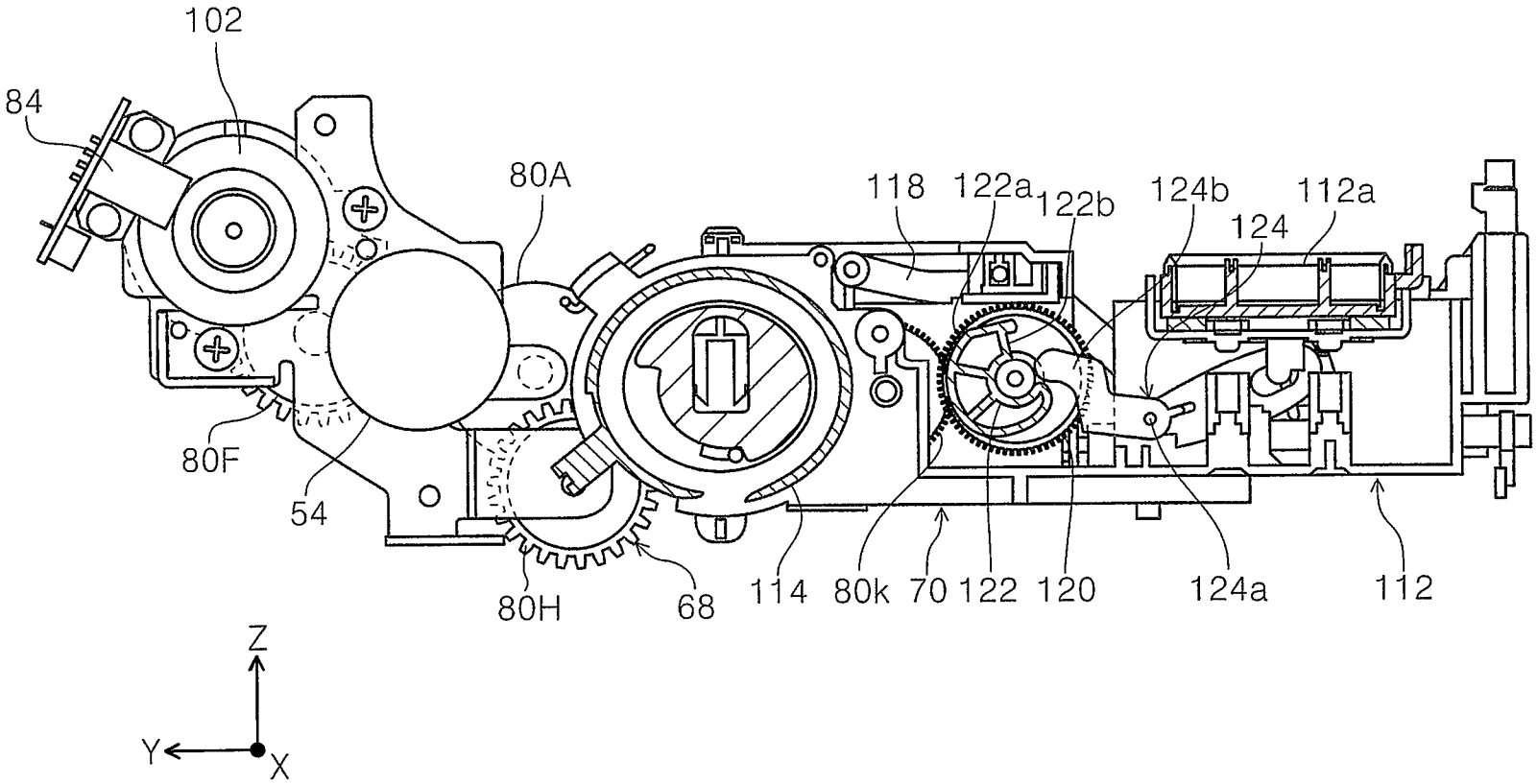
FIG. 17 is a side view cross-section illustrating a maintenance unit when a cap section of the maintenance unit is in a capped state.
Figure 18:
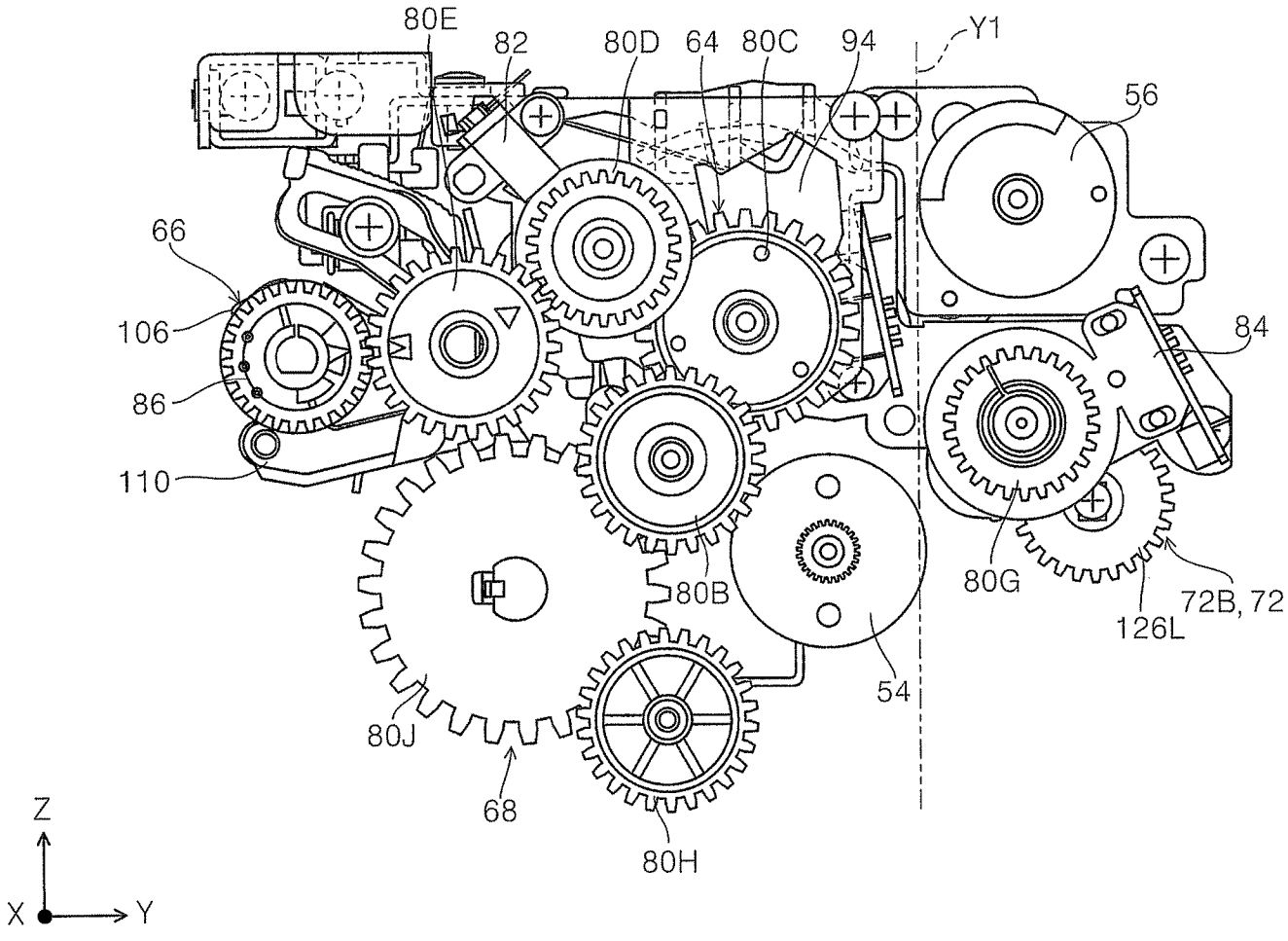
FIG. 18 is a face-on view illustrating a first motive force transmission unit and a third motive force transmission unit to explain a positional relationship between a first motor of the first motive force transmission unit and a second motor of the third motive force transmission unit in an apparatus depth direction.
Figure 19:
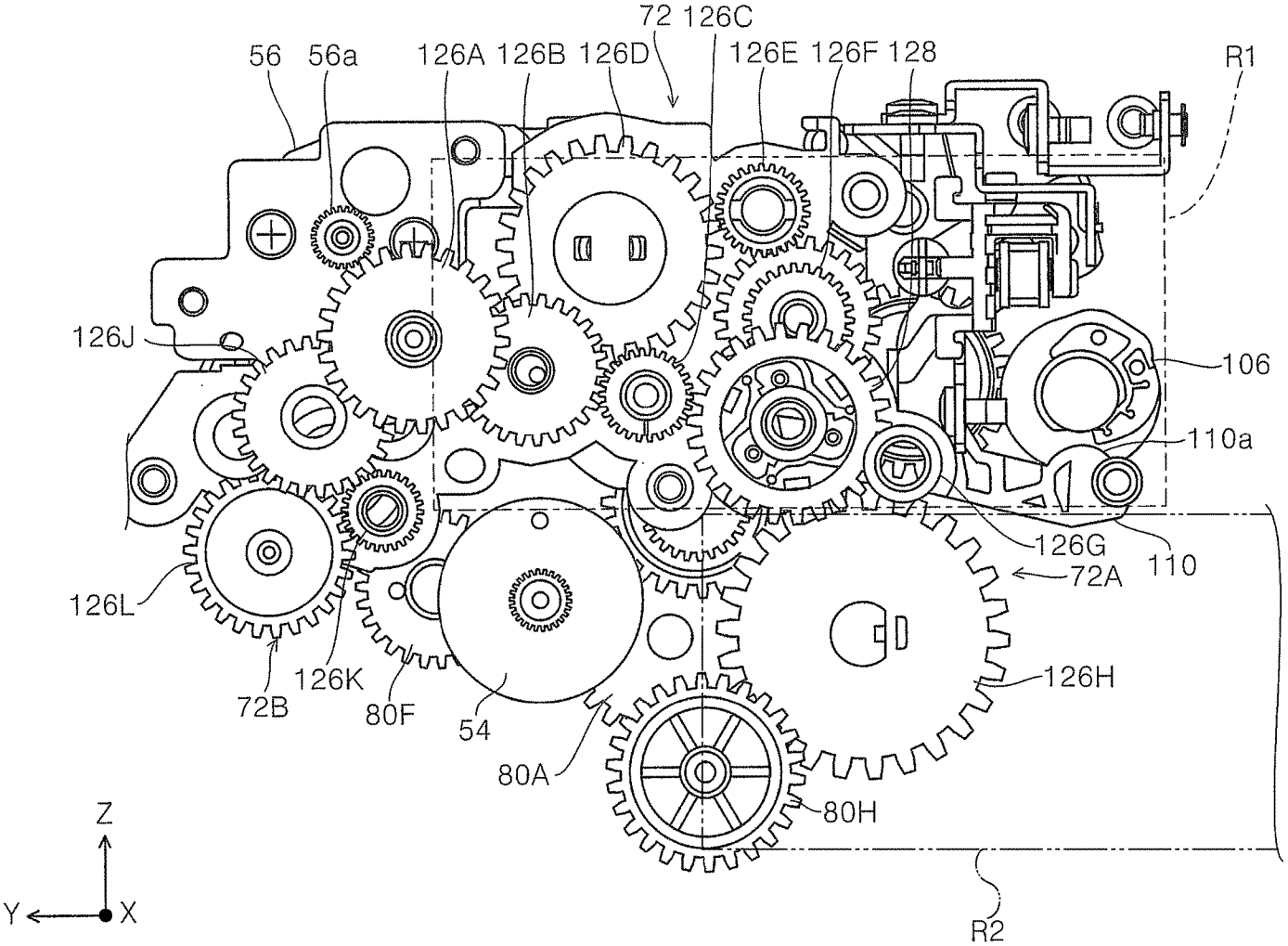
FIG. 19 is a face-on view illustrating a third motive force transmission unit.
Figure 20:
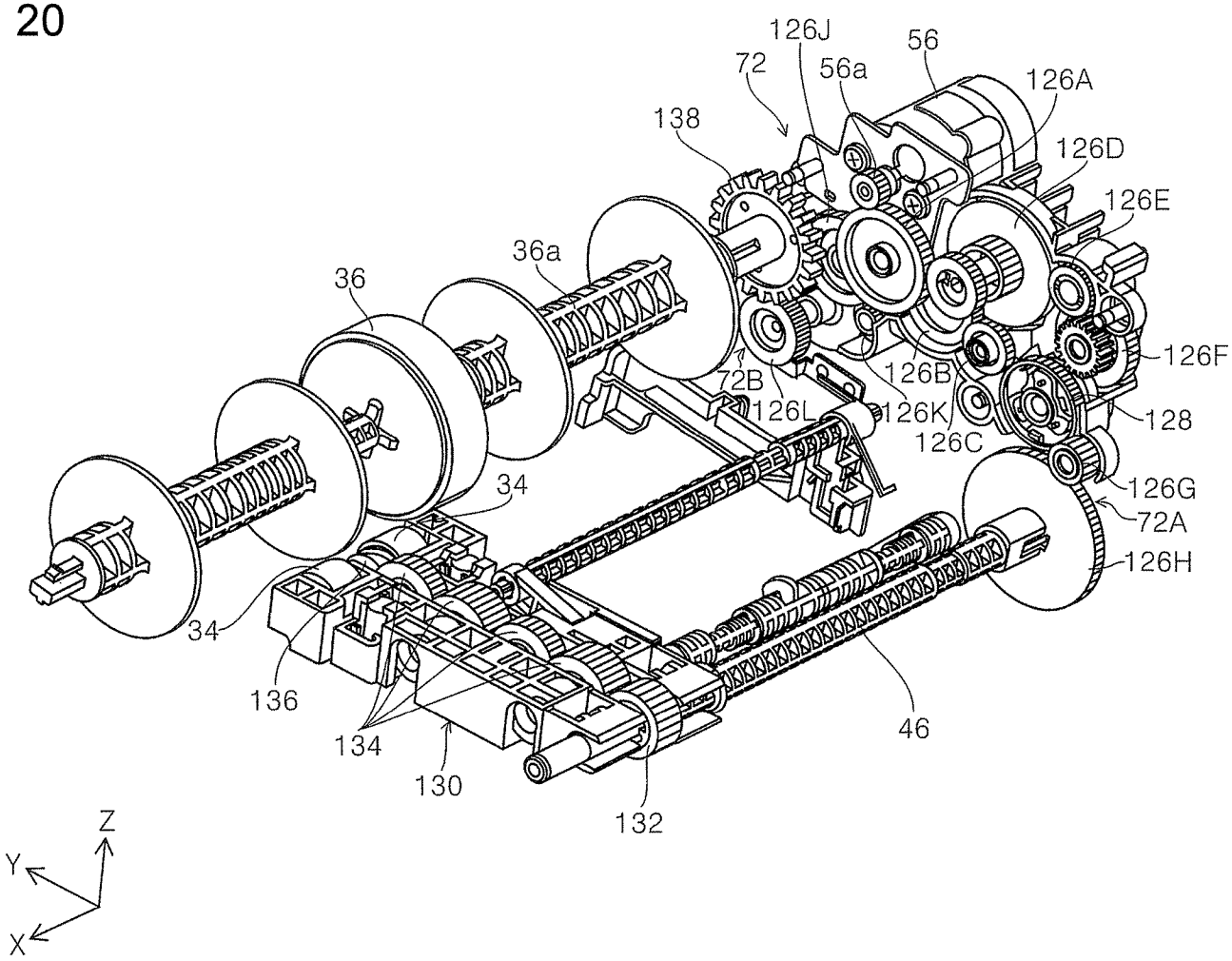
FIG. 20 is a perspective view illustrating a feed unit and a third motive force transmission unit.

FIG. 15 is a plan view illustrating a maintenance unit. FIG. 16 is a side view cross-section illustrating a maintenance unit when a cap section of the maintenance unit is in a non-capped state. FIG. 17 is a side view cross-section illustrating a maintenance unit when a cap section of the maintenance unit is in a capped state. FIG. 18 is a face-on view illustrating a first motive force transmission unit and a third motive force transmission unit to explain a positional relationship between a first motor of the first motive force transmission unit and a second motor of the third motive force transmission unit in an apparatus depth direction. FIG. 19 is a face-on view illustrating a third motive force transmission unit. FIG. 20 is a perspective view illustrating a feed unit and a third motive force transmission unit.

In the X-Y-Z coordinate system used in the respective drawings, the X direction indicates the main scan direction (movement direction) of a carriage, namely a width direction of a recording apparatus, the Y direction indicates a depth direction of the recording apparatus, and the Z direction indicates a height direction of the apparatus. In each of the drawings, a +X direction side indicates a left side of the apparatus, a −X direction side indicates a right side of the apparatus, a −Y direction side indicates a front face side of the apparatus, a +Y direction side indicates a back face side of the apparatus, a +Z direction side indicates an upper side of the apparatus, and a −Z direction side indicates a lower side of the apparatus.

Embodiments

Printer Overview

As illustrated in FIG. 1, a printer 10 includes an apparatus body 12, and a reader mechanism section 14 that is provided at an upper section of the apparatus body 12 and that is capable of reading source documents and the like. An operation section 16 is provided at an apparatus front face side of the apparatus body 12 so as to be capable of swinging (tilting) with respect to the apparatus body 12. The operation section 16 is configured capable of switching between a closed orientation with respect to the apparatus body 12 (see FIG. 1), and an orientation swung out toward the apparatus front face side with respect to the apparatus body 12 (see FIG. 2). The operation section 16 is provided with a display unit 18 such as a display panel.

A front face cover 20 is disposed below the operation section 16 at the apparatus front face side of the apparatus body 12. The apparatus body 12 is also provided with a paper discharge tray 22. The paper discharge tray 22 is configured capable of switching between a stored state inside the apparatus body 12 (see FIG. 1) and an opened out state at the apparatus front face side of the apparatus body 12 (see FIG. 2).

A medium feed-in port cover 24 is attached to an upper section of the back face side of the apparatus body 12 so as to be capable of swinging. The medium feed-in port cover 24 is configured capable of switching between a closed state with respect to the apparatus body 12, illustrated in FIG. 1, and an open state with respect to the apparatus body 12, illustrated in FIG. 2. Note that when the medium feed-in port cover 24 is closed, the medium feed-in port cover 24 configures part of an upper face of the apparatus body 12, specifically an upper face of a back face side in the apparatus depth direction.

Opening the medium feed-in port cover 24 exposes a medium feed-in port 26, in which a recording medium is set, at the back face side of the upper section of the apparatus body 12. When the recording medium is inserted into the medium feed-in port 26 in the arrow A direction, the inserted medium is guided along an inclined medium guide path 28 illustrated in FIG. 3 toward a transport direction downstream side.

Medium Transport Path

Next, explanation follows regarding a medium transport path 30 of the recording medium in the apparatus body 12, with reference to FIG. 3. The bold solid line indicated by the letter P in FIG. 3 indicates a guide path of the medium being transported along the medium transport path 30 from a cassette 32 to the paper discharge tray 22.

The cassette 32 that stores the recording medium is provided at a lower section of the apparatus body 12. The cassette 32 is formed in a box-shape, and is capable of internally storing the recording medium. Pick-up rollers 34, an inverting roller 36, following rollers 38*a*, 38*b*, 38*c*, a pair of transport rollers 40, a recording section 42, and a pair of discharge rollers 44 are provided in this sequence along the medium transport path 30 inside the apparatus body 12. Note that the pick-up rollers 34 and the inverting roller 36 configure an example of a feed unit. The pick-up rollers 34 are disposed above the cassette 32 so as to be capable of swinging about a swing shaft 46. The recording medium fed from the cassette 32 by the pick-up rollers 34 is nipped by the inverting roller 36 and the following rollers 38*a*, 38*b*, and transported to the pair of transport rollers 40.

The pair of transport rollers 40 transport the recording medium to the recording section 42. The recording section 42 includes a carriage 48, a recording head 50, and a medium support member 52. The carriage 48 is configured capable of moving to and fro in the apparatus width direction. The recording head 50 is provided to a lower section of the carriage 48. The recording head 50 is configured so as to eject ink toward the lower side in the apparatus height direction.

The medium support member 52 is provided below the recording head 50, in a region facing the recording head 50. The medium support member 52 faces the recording head 50, and defines a distance, namely a gap PG (see FIG. 9), between the medium support member 52 and the recording head 50. The medium support member 52 supports a lower face (a face on the opposite side to a recording face) of the recording medium that has been transported into the region facing the recording head 50 by the pair of transport rollers 40. The recording head 50 ejects ink toward the recording medium supported by the medium support member 52 in order to record on the recording face of the recording medium.

The recording medium on which recording has been performed is nipped by the pair of discharge rollers 44 provided on the transport direction downstream side of the recording section 42, and is discharged toward the paper discharge tray 22 (see FIG. 2) projecting out from the apparatus front face side.

Moreover, when the medium feed-in port cover 24 is opened and a recording medium is inserted into the medium feed-in port 26 from above the printer 10, the recording medium is guided by the medium guide path 28 and transported to the recording section 42, where it is recorded on by the recording section 42. After being recorded on, the recording medium is discharged to the paper discharge tray 22.

After recording on a first face (recording face) of the recording medium in the recording section 42, in cases in which recording is also performed on a second face (lower face) on the opposite side to the first face, the pair of transport rollers 40 are reversed, and the recording medium is transported toward the transport direction upstream side. The recording medium being transported toward the transport direction upstream side is nipped between the inverting roller 36 and the following roller 38*c*. The recording medium is then flipped between the first face and the second face by the inverting roller 36, transported to the recording section 42 again, and after the second face has been recorded on in the recording section 42, the recording medium is discharged toward the paper discharge tray 22.

Drive Motor Placement

Next, explanation follows regarding placement of a first motor and a fifth motor, with reference to FIG. 4 and FIG. 5. A first motor 54, a second motor 56, a third motor 58, a fourth motor 60, and a fifth motor 62 are provided inside the apparatus body 12 of the printer 10. The first motor 54 transmits motive force through a first motive force transmission unit 64, described later, to a gap switching unit 66 that switches the gap PG between the carriage 48 and the medium support member 52, and transmits motive force through a second motive force transmission unit 68 to a maintenance unit 70.

The second motor 56 transmits motive force through a third motive force transmission unit 72, described later, to the pick-up rollers 34 and the inverting roller 36 that serve as a "feed unit". The third motor 58 transmits motive force through a motive force transmission unit, not illustrated in the drawings, to the pair of transport rollers 40 and the pair of discharge rollers 44. The fourth motor 60 supplies motive force to a carriage drive unit 74, and moves the carriage 48 in the apparatus width direction. The fifth motor 62 supplies motive force to the operation section 16. The fifth motor 62 supplies motive force to the operation section 16, and swings the operation section 16 with respect to the apparatus body 12.

The first motor 54 and the second motor 56 are provided at an apparatus depth direction back face side of an apparatus width direction right side end section inside the apparatus body 12. As illustrated in FIG. 5, at least a portion of the first motor 54 and at least a portion of the second motor 56 overlap with each other in the apparatus width direction. In FIG. 18, the imaginary line labeled Y1 indicates the position of an apparatus depth direction front face side end portion of the second motor 56. Moreover, an apparatus depth direction back face side end portion of the first motor 54 is positioned further to the apparatus depth direction back face side than the imaginary line Y1. Namely, at least a portion of the first motor 54 and at least a portion of the second motor 56 overlap with each other in the apparatus depth direction.

The third motor 58 and the fourth motor 60 are provided at an apparatus depth direction back face side of an apparatus width direction left side end section inside the apparatus body 12. At least a portion of the third motor 58 and at least a portion of the fourth motor 60 overlap with each other in the apparatus depth direction and the apparatus width direction, as illustrated in FIG. 4 and FIG. 5. Moreover, the fifth motor 62 is disposed at an apparatus depth direction front face side inside the apparatus body 12.

Gap Switching Unit and First Motive Force Transmission Unit

Explanation follows regarding switching of the gap PG in the carriage 48, with reference to FIG. 6 to FIG. 13. As illustrated in FIG. 6 to FIG. 8, as an example, an apparatus width direction right side end section of the printer 10 is set as a home position of the carriage 48. As illustrated in FIG. 6 and FIG. 7, a guide shaft 76 extends in the apparatus width direction at the apparatus depth direction back face side of the carriage 48. The guide shaft 76 passes through a back face side end portion of the carriage 48. The guide shaft 76 guides movement of the carriage 48 in the apparatus width direction.

The carriage drive unit 74 is provided at the apparatus depth direction back face side of the carriage 48. The carriage drive unit 74 includes the fourth motor 60, respective pulleys, not illustrated in the drawings, provided at both apparatus width direction end sections of the apparatus body 12, and a drive belt 78 entrained around the pulleys. Part of the drive belt 78 is gripped by the carriage 48. The drive belt 78 is rotation-driven in the apparatus width direction by the fourth motor 60, thereby moving the carriage 48 in the apparatus width direction.

As illustrated in FIG. 7 and FIG. 8, the first motive force transmission unit 64, the gap switching unit 66, the second motive force transmission unit 68, the maintenance unit 70, and the third motive force transmission unit 72 (see FIG. 19 and FIG. 20) are provided at the apparatus width direction right side end section of the apparatus body 12.

The first motive force transmission unit 64 and the second motive force transmission unit 68 share the common first motor 54 for drive force. The first motive force transmission unit 64 is configured so as to transmit drive force of the first motor 54 to the gap switching unit 66. The gap switching unit 66 is configured to use the drive force of the first motor 54 to switch the gap PG between the carriage 48 and the medium support member 52. The second motive force transmission unit 68 is configured to transmit drive force of the first motor 54 to the maintenance unit 70. Note that the maintenance unit 70 will be described later. Namely, the gap switching unit 66 and the maintenance unit 70 are driven by the first motor 54 acting as a common motor.

Explanation now follows regarding the first motive force transmission unit 64 and the gap switching unit 66, with reference to FIG. 9 to FIG. 13. First, explanation is given regarding the first motive force transmission unit 64. The first motive force transmission unit 64 includes plural gears 80A, 80B, 80C, 80D, 80E, 80F, 80G, a detection sensor 82, an encoder sensor 84, and a gap adjustment cam drive gear 86 that is provided to one end of the guide shaft 76. Moreover, the first motive force transmission unit 64 is controlled by a controller, not illustrated in the drawings, provided inside the apparatus body 12. Specifically, the non-illustrated controller controls rotation of the first motor 54 based on detection information from the detection sensor 82 and the encoder sensor 84.

Rotation drive force of the first motor 54 is transmitted through a drive gear 54*a* attached to a drive shaft of the first motor 54, and transmitted in sequence through the mutually meshed gears 80A, 80B, 80C, and 80D. A planetary gear mechanism 88 (see FIG. 10 to FIG. 12) is provided between the gear 80C and the gear 80D, and the planetary gear mechanism 88 is configured so as to be capable of switching between a state meshed with the gear 80D and a state disengaged from the gear 80D.

As illustrated in FIG. 10 to FIG. 12, the planetary gear mechanism 88 includes a sun gear 90 that rotates coaxially to the gear 80C, a pivoting member 94 that is capable of pivoting centered on a rotation shaft 92 of the gear 80C, a planetary gear 98 attached to the pivoting member 94 and meshed with the sun gear 90, and a wire-shaped restriction bar 96. A friction member is interposed between the sun gear 90 and the pivoting member 94, and rotation torque is transmitted from the sun gear 90 to the pivoting member 94 by frictional force. Accordingly, the pivoting member 94 and the sun gear 90 rotate synchronized with one another within a pivoting range of the pivoting member 94, and the pivoting member 94 and the sun gear 90 are capable of idling with respect to one another when the pivoting member 94 has reached a pivoting limit.

When the drive gear 54*a* of the first motor 54 rotates in a first direction, namely in the counterclockwise direction in FIG. 8 and FIG. 9, the gear 80A is rotation driven in the clockwise direction in FIG. 9. Then, when the gear 80A rotates in the clockwise direction, the gear 80C is also rotation driven in the clockwise direction in FIG. 9 (the counterclockwise direction in FIG. 10) through the gear 80B. As a result, the sun gear 90 is rotation driven in the counterclockwise direction in FIG. 10. In this state, the planetary gear 98 that is meshed with the sun gear 90 is rotation driven in the clockwise direction in FIG. 10. However, in this state, the planetary gear 98 is in the state disengaged from the gear 80D, this being a state in which drive force of the first motor 54 cannot be transmitted to the gear 80D.

As illustrated in FIG. 11, when the gear 80C is rotation driven in the counterclockwise direction in FIG. 11, the pivoting member 94 pivots in the counterclockwise direction in FIG. 11 centered on the rotation shaft 92. Then, when the pivoting member 94 pivots in the counterclockwise direction in FIG. 11, the planetary gear 98 approaches the gear 80D. Then, as illustrated in FIG. 12, when the pivoting member 94 has pivoted further in the counterclockwise direction in FIG. 12, the planetary gear 98 meshes with the gear 80D. As a result, the planetary gear 98 transmits the rotation drive force of the first motor 54 to the gear 80D.

The rotation of the gear 80D is thereby transmitted to the gear 80E. Note that the gear 80E is meshed with the gap adjustment cam drive gear 86. Accordingly, the rotation of the gear 80E is transmitted to the gap adjustment cam drive gear 86, and the guide shaft 76 is rotated in the counterclockwise direction in FIG. 12.

Moreover, the pivoting member 94 is formed with restriction blocks 94*a*, 94*b*. A leading end of the restriction bar 96 on the pivoting member 94 side is bent into an L-shape toward the pivoting member 94 side in the apparatus width direction (a direction orthogonal to the page in FIG. 10) to configure a leading end 96*a*. The leading end 96*a* is configured so as to be capable of engaging with the restriction blocks 94*a*, 94*b*. The restriction blocks 94*a*, 94*b* and the restriction bar 96 configure a unit that constrains the orientation of the pivoting member 94. The leading end 96*a* of the restriction bar 96 is capable of following a path indicated by the dashed lines S in FIG. 10 around the periphery of the restriction block 94*a* accompanying the pivoting action of the pivoting member 94.

In the state illustrated in FIG. 10, when the gear 80C rotates in the counterclockwise direction in FIG. 10, the pivoting member 94 also pivots in the counterclockwise direction. Moreover, the leading end 96*a* of the restriction bar 96 is displaced toward the upper side of the restriction blocks 94*a* accompanying the pivoting of the pivoting member 94. The leading end 96*a* then fits into a constraint position 100 of the restriction block 94*b*, as illustrated in FIG. 11. In this state, the pivoting member 94 is restricted from pivoting any further in the counterclockwise direction in FIG. 11 than its current orientation. The planetary gear 98 is thus unable to mesh with the gear 80D.

From this state, when the pivoting member 94 pivots slightly toward the clockwise direction in FIG. 11, the leading end 96*a* moves toward the counterclockwise direction in FIG. 11 relative to the constraint position 100, moving away from the constraint position 100, and adopting a free state. When, in this state, the pivoting member 94 is once more pivoted in the counterclockwise direction in FIG. 11, the planetary gear 98 adopts a meshed state with the gear 80D, and drive force of the first motor 54 is transmitted through the gear 80E to the gap adjustment cam drive gear 86, and the guide shaft 76 is rotated in the counterclockwise direction in FIG. 12.

Moreover, referring once again to FIG. 9, rotation drive force of the first motor 54 is also transmitted to the gear 80F, and further transmitted to the gear 80G that is meshed with the gear 80F. A rotary scale 102 is attached to the gear 80G. When the gear 80G rotates, the rotary scale 102 also rotates in the same rotation direction, and the rotation amount thereof is detected by the encoder sensor 84. Namely, the encoder sensor 84 detects the rotation amount of the first motor 54.

The detection sensor 82 is, for example, configured by an optical sensor. The detection sensor 82 is configured so as to detect a projection 104 projecting out from an outer peripheral face of the gear 80D.

Next, explanation follows regarding the gap switching unit 66, with reference to FIG. 6 to FIG. 13. As illustrated in FIG. 7, FIG. 8, and FIG. 10 to FIG. 12, a gap adjustment cam 106 is provided coaxially to the gap adjustment cam drive gear 86 at an apparatus width direction right side end portion of the guide shaft 76. As illustrated in FIG. 6 and FIG. 13, a gap adjustment cam 108 is also provided at an apparatus width direction left side end portion of the guide shaft 76.

The gap adjustment cams 106, 108 attached to both apparatus width direction end portions of the guide shaft 76 are each supported by a support member 110 (see FIG. 8 and FIG. 13) attached to the apparatus body 12. Explanation follows regarding with reference to the gap adjustment cam 108 (see FIG. 13) serving as an example of the gap adjustment cams 106, 108.

An outer peripheral face of the gap adjustment cam 108 forms a cam face 108*a*. The cam face 108*a* is configured such that radii from the center of the gap adjustment cam 108 change in the sequence R1, R2, R3, R4 around a circumferential direction of the gap adjustment cam 108. Note that R1, R2, R3, and R4 have the relationship R1<R2<R3<R4. The gap adjustment cam 106 is configured similarly.

The gap adjustment cams 106, 108 are attached to the guide shaft 76 such that regions of the gap adjustment cam 106 having the radii R1, R2, R3, R4 from the center of the gap adjustment cam 106 are aligned with regions of the gap adjustment cam 108 having the radii R1, R2, R3, R4 from the center of the gap adjustment cam 108. Accordingly, when the guide shaft 76 is rotated, the gap adjustment cam 106 and the gap adjustment cam 108 are capable of moving the guide shaft 76, and therefore the carriage 48, upward and downward in the apparatus height direction, while maintaining the guide shaft 76 substantially horizontally on the support member 110.

Note that rotation drive force of the first motor 54 is transmitted to the gap adjustment cam 106 when there is a meshed state of the planetary gear 98 with the gear 80D as illustrated in FIG. 12. The gap adjustment cam 106 is thus rotated in the counterclockwise direction in FIG. 12. Accordingly, a distance between the centers of the gap adjustment cams 106, 108 and a cam support portion 110*a* of the corresponding support member 110 changes in the sequence R1, R2, R3, R4. Namely, the gap PG (see FIG. 9) between the recording head 50 and the medium support member 52 gradually becomes larger.

Moreover, if an attempt is made to rotate the gap adjustment cam 106 in the clockwise direction in FIG. 12 by driving the first motor 54 in reverse, the meshed state between the planetary gear 98 and the gear 80D is released such that the gap adjustment cam 106 cannot be rotated in the counterclockwise direction in FIG. 12. Namely, the first motor 54 is only capable of switching the gap PG when rotated in the counterclockwise direction in FIG. 9, this being a first direction.

Second Motive Force Transmission Unit and Maintenance Unit

Explanation follows regarding the second motive force transmission unit 68 and the maintenance unit 70 with reference to FIG. 7 and FIG. 8, as well as FIG. 14 to FIG. 17. As illustrated in FIG. 7, the maintenance unit 70 is provided at the apparatus width direction right side end section of the apparatus body 12, namely at a position corresponding to the home position of the carriage 48. The maintenance unit 70 includes a cap section 112 and a pump 114, for example. The cap section 112 is positioned at an apparatus height direction lower side of the recording head 50 of the carriage 48 when the carriage 48 is positioned at the home position.

The cap section 112 includes a cap 112*a* that is capable of switching between a capped state capping the recording head 50, and a non-capped state separated from the recording head 50, when the carriage 48 is positioned at the home position. The cap section 112 and the pump 114 are connected together by a waste ink tube 116, illustrated in FIG. 8. When the pump 114 is driven in a state in which the cap 112*a* is in the capped state capping the recording head 50, negative pressure is generated in the cap 112*a* through the waste ink tube 116 that links together the cap section 112 and the pump 114. This negative pressure sucks ink from nozzles of the recording head 50, enabling nozzle blockages and air bubble intrusion to be removed.

Waste ink arising in the cap section 112 is sucked out through the waste ink tube 116 by the pump 114. The waste ink that has been sucked out then passes through a waste ink tube 118 leading out from the pump 114, and is supplied to a waste ink repository, not illustrated in the drawings, provided at the apparatus depth direction front face side of the cap section 112.

Figure 14:
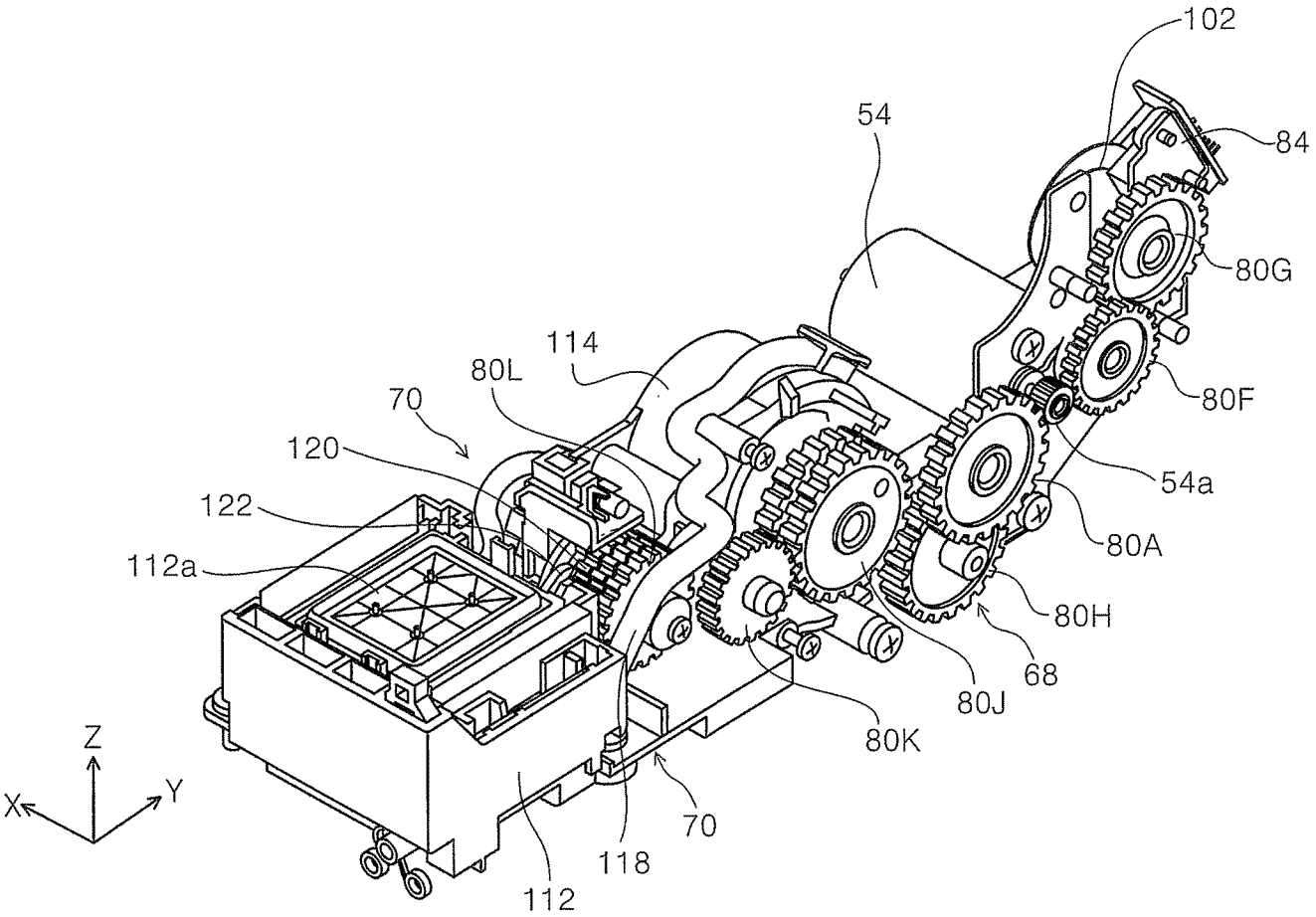
FIG. 14 is a perspective view illustrating a second motive force transmission unit and a maintenance unit.

Moreover, as illustrated in FIG. 14 and FIG. 15, the pump 114 is disposed at the apparatus depth direction back face side of the cap section 112. The first motor 54 is disposed at the apparatus depth direction back face side of the pump 114. The second motive force transmission unit 68 is disposed from the first motor 54 toward the cap section 112 at the apparatus depth direction front face side. The second motive force transmission unit 68 is positioned at the right side of the pump 114 in the apparatus width direction. Moreover, as illustrated in FIG. 15, at least a portion of the cap section 112 of the maintenance unit 70 overlaps with at least a portion of the second motive force transmission unit 68 in the apparatus width direction.

As illustrated in FIG. 7 and FIG. 8, the second motive force transmission unit 68 is disposed at the lower side of the first motive force transmission unit 64 in the apparatus height direction. The second motive force transmission unit 68 includes plural gears 80H, 80J, 80K, 80L. Note that the gear 80A of the first motive force transmission unit 64 is configured as a compound gear in which plural gears are provided coaxially to one another.

Moreover, the gear 80H is meshed with one gear, not illustrated in the drawings, of the gear 80A configured by a compound gear. The gear 80J is meshed with the gear 80H. The gear 80J is configured so as to transmit drive force of the first motor 54 to the pump 114. The pump 114 is configured so as to be driven when the gear 80J rotates in a specific direction. The gear 80J is meshed with the gear 80K, and the gear 80K is meshed with the gear 80L. The gear 80L is provided with a coaxial friction clutch 120 to the left in the apparatus width direction.

Moreover, as illustrated as an example in FIG. 7, a region where the plural gears 80J to 80L configuring the second motive force transmission unit 68 are provided is configured so as to overlap in the apparatus width direction with a region where the plural gears 80A to 80G configuring the first motive force transmission unit 64 are provided. Namely, at least a portion of the first motive force transmission unit 64 and at least a portion of the second motive force transmission unit 68 overlap with each other in the apparatus width direction.

Capping Operation

Explanation follows regarding operation of the cap 112*a* of the cap section 112, with reference to FIG. 16 and FIG. 17. The gear 80L (see FIG. 7) is provided with a cam 122 that is coaxially rotated through the friction clutch 120. The cam 122 has a locally notched shape, for example. In the following explanation, a portion of the cam 122 that is enlarged in the radial direction is referred to as the cam portion 122*a*, and a notched portion is referred to as a notch portion 122*b*.

The cap section 112 is provided with a link member 124. The link member 124 is configured capable of pivoting about a pivot shaft 124*a*. One end portion 124*b* of the link member 124 engages with the cam 122. The other end portion of the link member 124 is connected to the cap 112*a*.

As illustrated in FIG. 8, when the first motor 54 rotates in a second direction, namely the clockwise direction in FIG. 8, the gear 80A rotates in a counterclockwise direction. The gear 80H is also rotated in a clockwise direction by the gear 80A. The gear 80J is rotated in a counterclockwise direction by the gear 80H, driving the pump 114. The gear 80K is rotated in a clockwise direction by the gear 80J, and the gear 80L is rotated in a counterclockwise direction by the gear 80K.

The friction clutch 120 transmits rotation of the gear 80L to the cam 122. The cam 122 is thereby rotated in the clockwise direction in FIG. 16 and FIG. 17. Note that FIG. 16 illustrates a non-capped state of the cap 112*a*, this being a state in which the one end portion 124*b* of the link member 124 is engaged with the cam portion 122*a*.

When the cam 122 rotates in the clockwise direction in FIG. 16 and FIG. 17, the one end portion 124*b* of the link member 124 switches from the state engaged with the cam portion 122*a* to a state engaged with the notch portion 122*b*. Due to this switching action, the link member 124 pivots about the pivot shaft 124*a*, and the cap 112*a* is lifted up toward the apparatus height direction upper side, thereby switching the cap 112*a* from the non-capped state to the capped state.

Moreover, when the first motor 54 continues to rotate in the second direction, the one end portion 124*b* of the link member 124 switches from the state engaged with the notch portion 122*b* to a state engaged with the cam portion 122*a*, switching the cap 112*a* from the capped state to the non-capped state.

Note that the rotation amount of the first motor 54 in the cap switching operation is detected by the encoder sensor 84. The non-illustrated controller controls rotation of the first motor 54 based on the detection information from the encoder sensor 84, thereby controlling the cap switching operation.

When the first motor 54 rotates in the first direction (the counterclockwise direction in FIG. 9), the friction clutch 120 does not transmit rotation of the gear 80L to the cam 122, and so the non-capped state of the cap 112*a* is not switched to the capped state. Moreover, the gear 80J rotates in the opposite direction to the drive direction of the pump 114, namely the opposite direction to the specific direction, and so the pump 114 is not driven.

To summarize the foregoing explanation, when the first motor 54 is rotation driven in the counterclockwise direction in FIG. 8 and FIG. 9, this being the first direction, the first motive force transmission unit 64 uses the rotation of the first motor 54 in the first direction to transmit motive force to the gap switching unit 66, and the gap is switched. When this occurs, the second motive force transmission unit 68 transmits motive force to the maintenance unit 70 in a direction in which the maintenance unit 70 does not perform maintenance on the recording head 50. On the other hand, when the first motor 54 is rotation driven in the clockwise direction in FIG. 8 and FIG. 9, this being the second direction, the first motive force transmission unit 64 does not transmit motive force to the gap switching unit 66 since the planetary gear mechanism 88 is in the disengaged state. Moreover, the second motive force transmission unit 68 transmits motive force to the maintenance unit 70 in the direction in which the maintenance unit 70 performs maintenance on the recording head 50, such that maintenance of the recording head 50 is performed.

Second Motor and Third Motive Force Transmission Unit

Next, explanation follows regarding the second motor 56 and the third motive force transmission unit 72, with reference to FIG. 19 and FIG. 20. The third motive force transmission unit 72 is, for example, configured to transmit motive force to the pick-up rollers 34 and the inverting roller 36 configuring the feed unit.

A drive gear 56*a* is attached to a drive shaft of the second motor 56. The third motive force transmission unit 72 includes a motive force transmission path 72A that transmits motive force to the pick-up rollers 34, and a motive force transmission path 72B that transmits motive force to the inverting roller 36.

First, explanation follows regarding the motive force transmission path 72A. The motive force transmission path 72A includes mutually meshed gears 126A, 126B, 126C, 126D, 126E, 126F, 126G, 126H, and a unidirectional clutch 128. Drive force of the second motor 56 is transmitted in sequence through the drive gear 56*a*, the gear 126A, the gear 126B, the gear 126C, the gear 126D, the gear 126E, the gear 126F, the unidirectional clutch 128, the gear 126G, and the gear 126H. Note that the gear 126H is attached to one end of the swing shaft 46 that swings the pick-up rollers 34. The unidirectional clutch 128 transmits drive force from the second motor 56 only in a rotation direction in which the pick-up rollers 34 feed the medium from the cassette 32 toward the feed direction downstream side.

As illustrated in FIG. 20, a leading end of the swing shaft 46 axially supports a pick-up roller unit 130 including the pick-up rollers 34. Moreover, a transmission gear 132 is attached to the swing shaft 46 on the opposite side to the side provided with the gear 126H in the apparatus width direction. The transmission gear 132 transmits drive force to a drive gear 136 through plural relay gears 134 provided to the pick-up roller unit 130. The drive gear 136 is attached to the pick-up roller unit 130 coaxially to the pick-up rollers 34. Rotation of the drive gear 136 rotates the pick-up rollers 34 in the same direction as the drive gear 136.

Next, explanation follows regarding the motive force transmission path 72B. The motive force transmission path 72B includes mutually meshed gears 126A, 126J, 126K, 126L. Drive force of the second motor 56 is transmitted in sequence through the drive gear 56*a*, the gear 126A, the gear 126J, the gear 126K, and the gear 126L.

A drive gear 138 is attached to one end portion of a rotation shaft 36*a* of the inverting roller 36. The drive gear 138 and the gear 126L are meshed together. Accordingly, drive force of the second motor 56 is supplied to the inverting roller 36 through the motive force transmission path 72B and the drive gear 138.

Returning once again to FIG. 19, explanation follows regarding the positional relationship between the first motive force transmission unit 64, the gap switching unit 66, the second motive force transmission unit 68, the maintenance unit 70, and the third motive force transmission unit 72 at the apparatus width direction right side end section of the apparatus body 12.

The third motive force transmission unit 72 is disposed adjacent to the first motive force transmission unit 64 and the second motive force transmission unit 68 in the apparatus width direction. As an example, the third motive force transmission unit 72 is disposed at the apparatus width direction left side of the first motive force transmission unit 64 and the second motive force transmission unit 68. In FIG. 19, the region indicated by the single-dotted dashed lines labeled R1 is an approximate region in which the first motive force transmission unit 64 and the gap switching unit 66 are provided. The region indicated by the double-dotted dashed lines labeled R2 is an approximate region in which the second motive force transmission unit 68 and the maintenance unit 70 are provided.

The region R1 (the region where the first motive force transmission unit 64 and the gap switching unit 66 are provided) and the region R2 (the region where the second motive force transmission unit 68 and the maintenance unit 70 are provided) are disposed overlapping in the apparatus height direction, and are disposed so as to be contained within a region in which the third motive force transmission unit 72 is provided in the apparatus height direction. This thereby enables the space taken up by the motive force transmission units in the apparatus width direction of the apparatus body 12 to be made smaller than in cases in which the first motive force transmission unit 64, the second motive force transmission unit 68, and the third motive force transmission unit 72 are each disposed offset from one another in the apparatus width direction. This thereby enables a reduction in the size of the printer 10 in the apparatus width direction.

Moreover, the gap switching unit 66 and the maintenance unit 70 share the first motor 54 as a common drive motor, thereby enabling the number of motors in the printer 10 to be reduced, and thus enabling a reduction in costs.

Modified Example of the Embodiment

In the present embodiment, configuration is made in which the first motive force transmission unit 64, the gap switching unit 66, the second motive force transmission unit 68, the maintenance unit 70, and the third motive force transmission unit 72 are provided at the apparatus width direction right side end section. However, instead of this configuration, they may be provided at the apparatus width direction left side end section.

To summarize the foregoing explanation, the printer 10 includes the carriage 48 including the recording head 50 configured to record on the medium, the medium support member 52 that is provided at a position facing the recording head 50 and that is configured to support the medium, the gap switching unit 66 that is configured to switch the gap PG to the recording head 50, and the maintenance unit 70 that is configured to perform maintenance on the recording head 50. The gap switching unit 66 and the maintenance unit 70 are driven by the first motor 54 as a common motor.

According to the above configuration, the maintenance unit 70 and the gap switching unit 66 are driven using the first motor 54 as a common motor. Using the first motor 54 as a common motor to drive both the maintenance unit 70 and the gap switching unit 66, which there is little need to operate at the same time, improves the degrees of freedom for other drive targets, enabling more efficient operation of the printer 10 to be achieved.

The maintenance unit 70 includes the cap section 112 that is configured to switch between the capped state capping the recording head 50, and the non-capped state separated from the recording head 50, and the pump 114 that generates negative pressure in the cap section 112. The cap section 112 and the pump 114 are driven by the first motor 54.

The first motor 54, the first motive force transmission unit 64 configured to transmit motive force from the first motor 54 to the gap switching unit 66, the maintenance unit 70, and the second motive force transmission unit 68 configured to transmit motive force from the first motor 54 to the cap section 112 are provided at the one side end section of the apparatus body 12 in the apparatus width direction, and at least a portion of the first motive force transmission unit 64 and at least a portion of the second motive force transmission unit 68 overlap with each other in the apparatus width direction. This configuration enables an apparatus width direction dimension of the printer 10 including the first motive force transmission unit 64 and the second motive force transmission unit 68 to be suppressed.

At least a portion of the maintenance unit 70, more specifically the cap section 112, and at least a portion of the second motive force transmission unit 68 overlap with each other in the apparatus width direction. This configuration enables the apparatus width direction dimension of the printer 10 including the maintenance unit 70 and the second motive force transmission unit 68 to be suppressed.

The first motive force transmission unit 64 includes the planetary gear mechanism 88 that is configured to transmit motive force to the gap switching unit 66 using rotation of the first motor 54 in the first direction, and that is configured to cut off motive force transmission to the gap switching unit 66 when the first motor 54 rotates in the second direction opposite to the first direction. The second motive force transmission unit 68 is configured to transmit rotational motive force to the maintenance unit 70 in the direction in which the maintenance unit 70 performs maintenance on the recording head 50 when the first motor 54 rotates in the second direction, and to transmit rotational motive force to the maintenance unit 70 in the direction in which the maintenance unit 70 does not perform maintenance on the recording head 50 when the first motor 54 rotates in the first direction. This configuration enables the difference in rotation direction of the first motor 54 to be utilized to drive the gap switching unit 66 and the maintenance unit 70 using a single motor.

The printer 10 further includes the pick-up rollers 34 and the inverting roller 36 that serve as the feed unit that feeds the medium. The motor that drives the gap switching unit 66 and the maintenance unit 70 is configured by the first motor 54. The second motor 56 that drives the pick-up rollers 34 and the inverting roller 36 is provided separately to the first motor 54, and at least a portion of the first motor 54 and at least a portion of the second motor 56 overlap with each other in the apparatus width direction. This configuration enables the apparatus width direction dimension of the printer 10 including the first motor 54 and the second motor 56 to be suppressed.

The printer 10 further includes the pick-up rollers 34 and the inverting roller 36 that serve as the feed unit that feeds the medium. The motor that drives the gap switching unit 66 and the maintenance unit 70 is configured by the first motor 54. The second motor 56 that drives the pick-up rollers 34 and the inverting roller 36 is provided separately to the first motor 54, and at least a portion of the first motor 54 and at least a portion of the second motor 56 overlap with each other in the apparatus depth direction. This configuration enables the apparatus depth direction dimension of the printer 10 including the first motor 54 and the second motor 56 to be suppressed.

Moreover, in the present embodiment, the first motive force transmission unit 64 and the second motive force transmission unit 68 according to the invention are applied to an ink jet printer as an example of a recording apparatus. However, general application may also be made to other liquid ejecting apparatuses.

Note that the liquid ejecting apparatus is not limited to a recording apparatus such as a printer, copier, or fax machine employing an ink jet recording head and recording onto a recording medium by ejecting ink from the ink jet recording head. The liquid ejecting apparatus also encompasses an apparatus that ejects a liquid for a given purpose, other than ink, onto an ejection receiving medium, corresponding to the recording medium, from a liquid ejecting head corresponding to the ink jet recording head, and causes the liquid to adhere to the ejection receiving medium.

Other than the recording head, examples of liquid ejecting heads include colorant ejecting heads employed in the manufacture of color filters for liquid crystal displays or the like, electrode material (conductive paste) ejecting heads employed to form electrodes of organic EL displays, field emission displays (FEDs), or the like, bioorganic matter ejecting heads employed in the manufacture of biochips, and sample ejecting heads employed as precision pipettes.

The invention is not limited to the above embodiment, and obviously various modifications may be implemented within the scope of the invention as recited in the scope of claims, and such modifications would also be encompassed within the scope of the invention.

The entire disclosure of Japanese Patent Application No. 2016-136522, filed Jul. 11, 2016 is expressly incorporated by reference herein.

What is claimed is:

1. A recording apparatus comprising:

a carriage that includes a recording head configured to record on a medium;

a medium support member that is provided at a position facing the recording head and that is configured to support the medium;

a gap switching unit that is configured to switch a gap between the medium support member and the recording head; and a maintenance unit that is configured to perform maintenance on the recording head; and wherein the gap switching unit and the maintenance unit being driven by a common motor, wherein the maintenance unit includes:

a cap section that is configured to switch between a capped state capping the recording head and a non-capped state separated from the recording head, and a pump that generates negative pressure in the cap section; and the cap section and the pump are driven by the motor wherein the motor, a first motive force transmission unit configured to transmit motive force from the motor to the gap switching unit, the maintenance unit, and a second motive force transmission unit configured to transmit motive force from the motor to the cap section are provided at one side end section of an apparatus body in a width direction of the recording apparatus and at least a portion of the first motive force transmission unit and at least a portion of the second motive force transmission unit overlap with each other in the apparatus width direction, wherein the first motive force transmission unit includes a planetary gear mechanism that is configured to transmit motive force to the gap switching unit using rotation of the motor in a first direction, and that is configured to cut off motive force transmission to the gap switching unit when the motor rotates in a second direction opposite to the first direction, and wherein the second motive force transmission unit is configured to transmit rotational motive force to the maintenance unit in a direction in which the maintenance unit performs maintenance on the recording head when the motor rotates in the second direction, and to transmit rotational motive force to the maintenance unit in a direction in which the maintenance unit does not perform maintenance on the recording head when the motor rotates in the first direction.

2. The recording apparatus according to Claim 1, wherein at least a portion of the maintenance unit and at least a portion of the second motive force transmission unit overlap with each other in the apparatus width direction.

3. A recording apparatus comprising:

a carriage that includes a recording head configured to record on a medium;

a maintenance unit that is configured to perform maintenance on the recording head;

a feed unit configured to feed the medium;

a first motor configured to drive the maintenance unit and a gap switching unit, the first motor being continuously connected to a portion of a first motive force transmission unit configured to transmit motive force from the first motor to the gap switching unit and a second motive force transmission unit configured to transmit motive force from the first motor to a cap section; and a second motor configured to drive the feed unit; and wherein at least a portion of the first motor and at least a portion of the second motor overlapping with each other in a width direction of the recording apparatus.

4. A recording apparatus comprising:

a carriage that includes a recording head configured to record on a medium;

a maintenance unit that is configured to perform maintenance on the recording head;

a feed unit configured to feed the medium;

a first motor configured to drive the maintenance unit and a gap switching unit, the first motor being continuously connected to a portion of a first motive force transmission unit configured to transmit motive force from the first motor to the gap switching unit and a second motive force transmission unit configured to transmit motive force from the first motor to a cap section; and a second motor configured to drive the feed unit; and wherein at least a portion of the first motor and at least a portion of the second motor overlapping with each other in a depth direction of the recording apparatus.

* * * * *